US007437779B2

(12) United States Patent
Kenny et al.

(10) Patent No.: US 7,437,779 B2
(45) Date of Patent: Oct. 21, 2008

(54) FIXTURE GUARD PANELS AND SYSTEMS

(75) Inventors: Robert W. Kenny, Acworth, GA (US); Steve Schneider, Atlanta, GA (US); Russell W. Rice, Jr., Acworth, GA (US); Michael Socha, Avondale Estates, GA (US); Richard Todd Spurlin, Fayetteville, GA (US); Stan Hunt, Avondale Estates, GA (US); Jack Garbow, Atlanta, GA (US)

(73) Assignee: Fixture Guards International, Inc., Clarkston, GA (US)

( * ) Notice: Subject to any disclaimer, the term of this patent is extended or adjusted under 35 U.S.C. 154(b) by 235 days.

(21) Appl. No.: 10/731,396

(22) Filed: Dec. 9, 2003

(65) Prior Publication Data

US 2004/0154232 A1 Aug. 12, 2004

(51) Int. Cl.
*A47K 3/02* (2006.01)

(52) U.S. Cl. ..... 4/580; 4/657; 4/DIG. 18

(58) Field of Classification Search ..... 4/580–583, 4/657, DIG. 18
See application file for complete search history.

(56) References Cited

U.S. PATENT DOCUMENTS

| | | | | | |
|---|---|---|---|---|---|
| 2,495,602 | A * | 1/1950 | Rinaldi | 4/583 |
| 3,133,292 | A * | 5/1964 | Spier | 4/580 |
| 3,563,837 | A * | 2/1971 | Smith et al. | 428/71 |
| 4,037,591 | A * | 7/1977 | Sarno | 601/57 |
| 4,574,976 | A * | 3/1986 | Hess et al. | 220/315 |
| 4,630,323 | A * | 12/1986 | Sage et al. | 4/580 |
| 5,085,212 | A * | 2/1992 | DeCosta | 607/95 |
| 6,112,340 | A * | 9/2000 | Ziebert et al. | 4/498 |
| 6,336,231 | B1 * | 1/2002 | Smith | 4/580 |
| 6,353,943 | B1 * | 3/2002 | Stevens | 4/582 |
| 6,453,485 | B2 * | 9/2002 | Bullock | 4/580 |

OTHER PUBLICATIONS

Tub Protection, Tub Shield, Surface Shields, Inc., http://www.surfaceshields.com/tub.html, date unknown.

Pro Tect, Liquid Mask, http://www.pro-tect.com/liquidmask.shtml, date unknown.

(Continued)

*Primary Examiner*—Huyen Le
(74) *Attorney, Agent, or Firm*—Withers & Keys, LLC

(57) ABSTRACT

Fixture guard panels and systems provide protection for fixtures such as tubs and showers. The fixture guard panels may have a variety of configurations such as including an enclosure formed of a flexible material that contains a padding layer. The panel may be placed adjacent the fixture such that the panel protects the fixture from impacts and abrasions. The panel may include individual sheets of material to enclose padding, may include padding without an enclosure, or may include an individual sheet without padding. The individual sheets may be materials such as polyethylene and/or non-skid rubber. For panels with non-skid rubber, the panel may be positioned so that the non-skid rubber portion contacts the fixture and will not skid. Panels may include flexible sheets with adhesive that adheres to the fixture, such as upon vertical fixture surfaces. Additionally, multiple panels may be included as a system. The multiple panels may be interconnected at junctions that allow the panels to form fit to a particular fixture.

30 Claims, 20 Drawing Sheets

OTHER PUBLICATIONS

Plasticare, Tube Care Film, http://www.agriplasticare.com/index.asp?PageAction=VIEWPROD&ProdID=33, date unknown.

Plasticare, Self-adhesive Film for Tub, Tile, & Sink, http://64.49.247.91/index.asp?PageAction=Custom&ID=6, date unknown.

Tub Protectors, Bath Tub Protector with Non-skid Foam Bottom, Banjamin Mfg. Co., http://www.ackralacd.com/tubprotector.htm, date unknown.

Blake Products, Bathtub Protection, http://www.blakeproducts.com, date unknown.

* cited by examiner

FIXTURE GUARD PANELS AND SYSTEMS

TECHNICAL FIELD

The present invention relates to protection of fixtures, such as tubs and showers. More particularly, the present invention relates to fixture guard panels and systems that may be positioned on fixtures to protect the fixtures from damage.

BACKGROUND

Fixtures such as tubs and showers are vulnerable components of a construction site. Typically, the tubs, showers, and other fixtures must be installed early in the construction process when individual rooms are being framed. Thus, the fixtures are placed into the construction site when many tasks remain to be completed.

Workers such as plumbers, dry wall hangers, and carpenters must continue to work nearby the fixtures and/or work with the fixtures after the fixtures have been framed in place. These workers use various tools such as hammers and wrenches that will inevitably be dropped from time to time. Occasionally, these tools are dropped onto the fixture, which results in damage such as a dent, crack, abrasion, or hole. Furthermore, these workers often need to stand on the fixture, which may result in similar fixture damage. Ladders may need to be placed on the fixture, which may lead to further damage. In addition, general construction items such as nails, caulking, mud, plaster, etc. as well as debris may find there way onto the fixtures and result in more damage.

This damage to the fixtures has come to be expected. Often, builders budget in a fixed sum to cover repairs of the damage caused to the fixtures after they have been installed. Thus, this damage to the fixtures increases the overall costs of construction projects. Furthermore, some damage may be so great that the fixture cannot be repaired but must be replaced instead. This situation increases the costs of the project but may also delay the project due to the time required to obtain and install a replacement fixture.

Previous attempts to protect the fixture have been inadequate. Some of these attempts have utilized a rigid, thin gauge plastic structure that is positioned on the fixture. However, this rigid structure typically is not a perfect fit such that there is movement of the rigid structure within the fixture. This movement can itself cause abrasions to the fixture. Furthermore, the rigid structure does not adequately protect the fixture from dropped items that create an impact force that is transferred through the rigid structure to the fixture. Additionally, transporting and installing the rigid structure is awkward and difficult. Other attempts involve the use of spray on foam that is applied directly to the surface of the fixture. While this spray on foam may provide some degree of protection, its application is a messy process, and it is very difficult to remove from the fixture.

SUMMARY

Embodiments of the present invention address these issues and others by providing flexible fixture guard panels and systems of flexible fixture guard panels. The flexible panels may be of various configurations. For example, the configurations may include padding to protect from impacts, non-skid surfaces to prevent skidding of the fixture, and adhesive layers to prevent the panels from separating from the fixture. Fixture guard systems include multiple panels. The multiple panels may be interconnected at junctions that allow the panels to move with respect to one another so that the panels may form-fit to the fixture to better protect it.

One embodiment is a fixture guard panel for protecting a fixture. The fixture guard includes an enclosure that includes a first side made of a first flexible material and a second side made of the first flexible material with the first side facing away from the fixture when the fixture guard panel is positioned on the fixture. The fixture guard panel further includes an inner layer comprising padding that is disposed within the enclosure.

Another embodiment is a fixture guard panel for protecting a fixture. The fixture guard panel includes a first sheet of a first flexible material and a second sheet of a second flexible material. A padding layer is disposed between the first sheet and the second sheet, and the first sheet and the second sheet are joined at one or more edges to contain the padding layer. The sheets may be of various materials such as a flexible plastic and/or a rubber non-skid surface.

Another embodiment is fixture guard panel for protecting a fixture. The fixture guard panel includes a flexible sheet of material and a padding layer. An adhesive layer is attached to the flexible sheet of material and adheres to a surface of the fixture when the fixture guard panel is positioned on the fixture.

Another embodiment is a fixture guard system for protecting a fixture. The fixture guard system includes a first fixture guard panel that includes a flexible material that is adjacent a first surface of a fixture. A second fixture guard panel includes a flexible material that is adjacent a second surface of a fixture. A junction between the first fixture guard panel and second fixture guard panel allows the first fixture guard panel and second fixture guard panel to move relative to one another.

Another embodiment is a fixture guard system for protecting a fixture. The fixture guard system includes a first fixture guard panel that includes a flexible material that is adjacent a first surface of a fixture. The first fixture guard panel also includes a padding layer that is disposed between a first sheet and a second sheet where the first sheet and the second sheet are joined at one or more edges to contain the padding layer. A second fixture guard panel includes a flexible material that is adjacent a second surface of the fixture. A junction between the first fixture guard panel and second fixture guard panel allows the first fixture guard panel and second fixture guard panel to move relative to one another.

Another embodiment is a fixture guard system for protecting a fixture. The fixture guard system includes a first fixture guard panel comprising a padding layer that is adjacent a first surface of the fixture and a second fixture guard panel that is adjacent a second surface of the fixture. The fixture guard system further includes a junction between the first fixture guard panel and second fixture guard panel to allow the first fixture guard panel and second fixture guard panel to move relative to one another.

DETAILED DESCRIPTION

Embodiments of the present invention provide panels and systems of panels that protect fixtures from damage. The fixture guard panels may be of a variety of forms depending upon the particular need. Furthermore, the fixture guard systems are formed from multiple fixture guard panels, where the fixture guard panels of the system may also be of a variety of forms to address the protection needs of a particular fixture.

Figure 1:
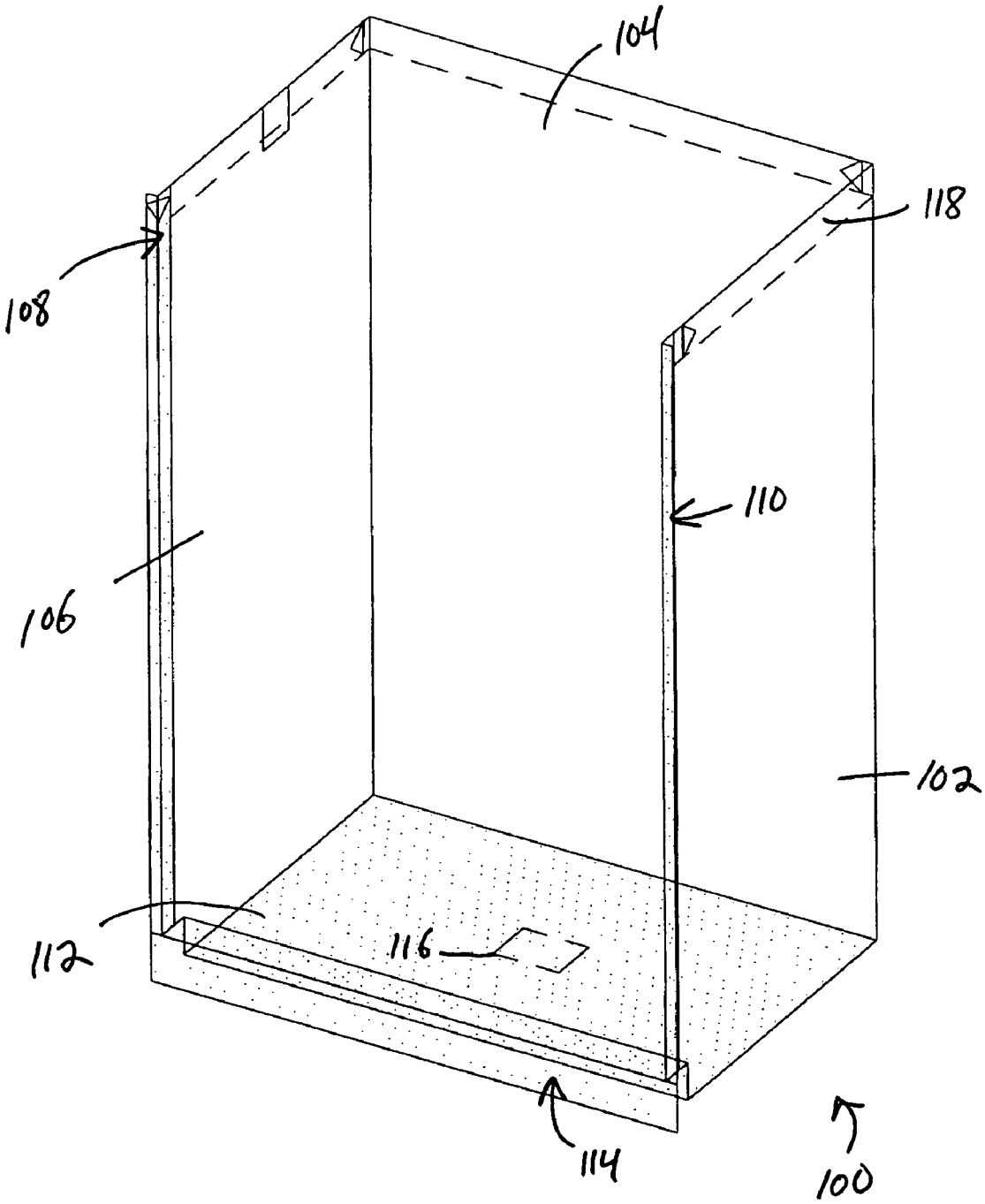
FIG. 1 is a front perspective view of an embodiment of a fixture guard system for a shower having various embodiments of fixture guard panels.

FIG. 1 shows one embodiment of a fixture guard system 100 that includes multiple flexible fixture guard panels to provide protection for a shower fixture. A first flexible fixture guard panel 102 protects a side of the shower fixture, a second flexible panel 104 protects a rear side of the shower fixture, and a third flexible panel 106 protects another side of the shower fixture. A fourth flexible panel 112 protects a floor of the shower fixture while providing a drain access flap 116. Flexible panels 108 and 110 protect the front vertical corners of the shower fixture while a combination of flexible panels 114 protects a front step of the shower fixture.

These panels are joined together at various junctions to form the fixture guard system. The junctions of the panels are discussed in more detail below. Furthermore, these various panels may be of various configurations. The particular configurations of the panels for this system 100 are also described in more detail below. These panels described here include woven polyethylene for at least one surface of each panel. The woven polyethylene of the embodiments described herein includes a high-density woven polyethylene with a low-density polyethylene coating. This provides a flexible but durable outer surface for the fixture guard systems described herein. However, it will be appreciated that various other materials, including plastics other than polyethylene may be used in place of woven polyethylene to provide a durable but flexible panel.

Figure 2:
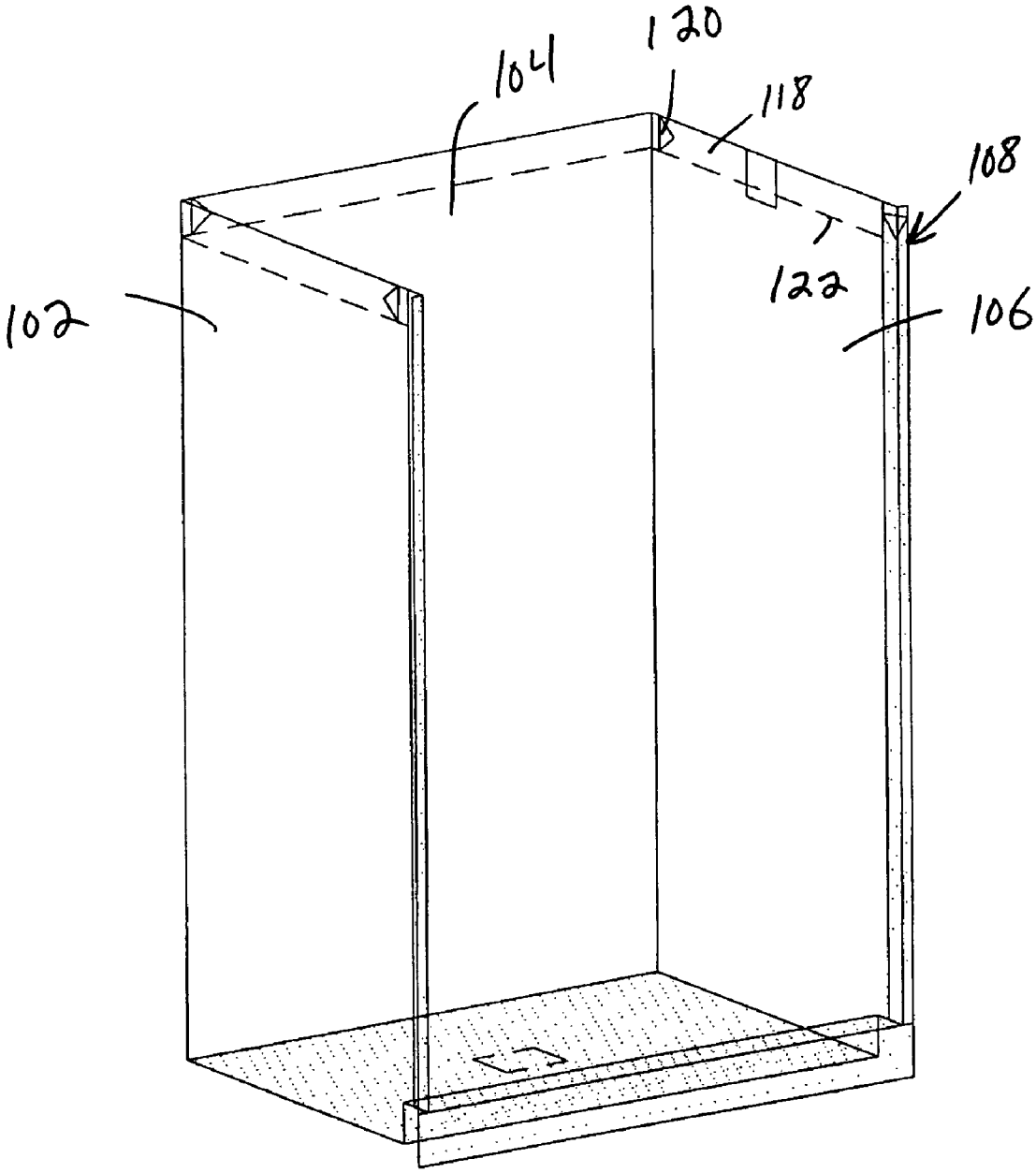
FIG. 2 is a rear perspective view of the embodiment of FIG. 1.

FIG. 2 shows a rear view of the fixture guard system 100. From this view, attachment tape 118 can be seen extending horizontally along the upper edges of the panels 104, 106 and vertically along the panel 108. Tape 118 is shown extending horizontally along the top edge of panel 102 in FIG. 1. This tape 118 has an adhesive surface facing outward from the fixture guard panels to which it is attached so that the tape can adhere to the walls of the shower fixture to hold the fixture guard system 100 in place.

Figure 4:
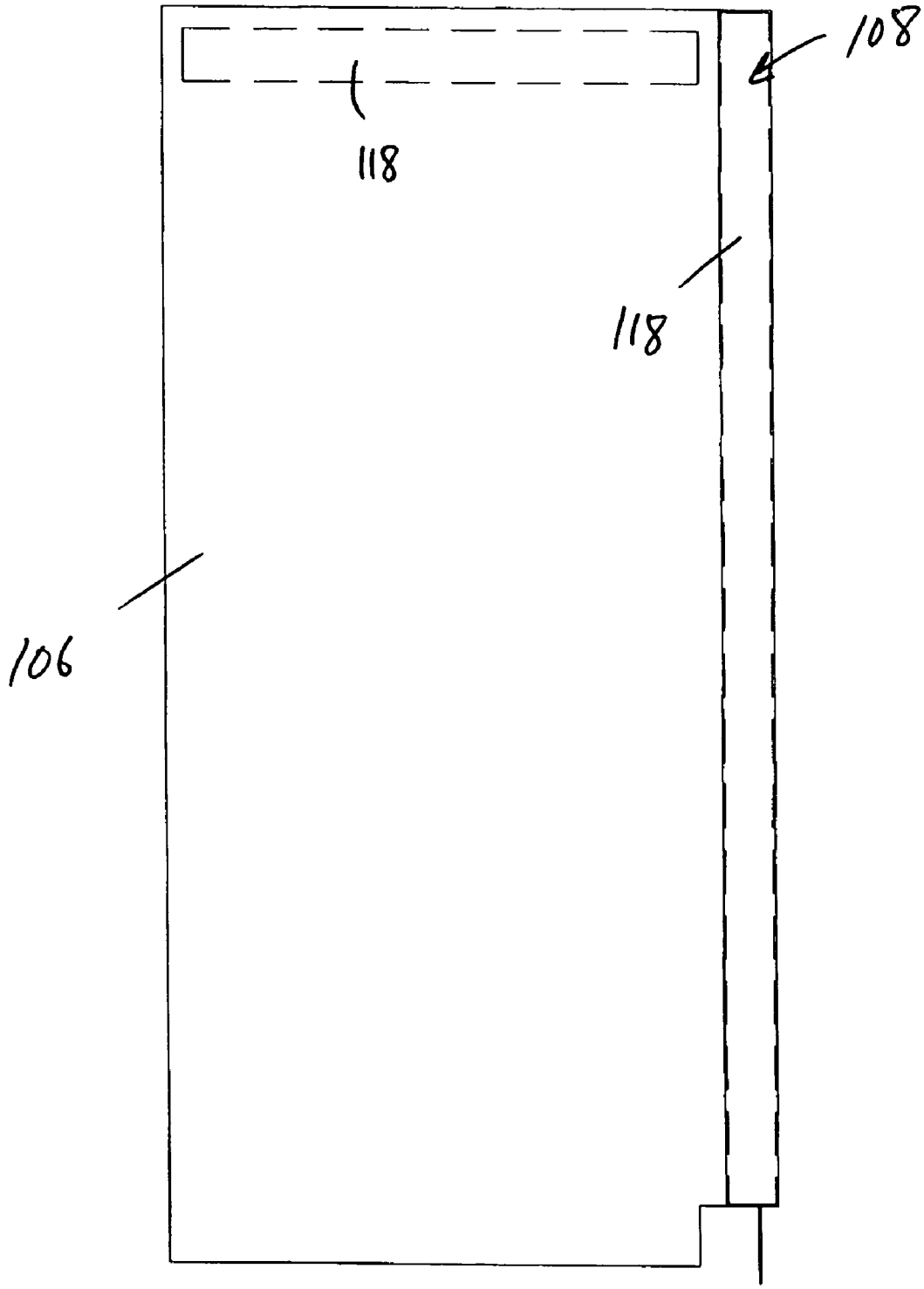
FIG. 4 is a side elevational view of the embodiment of FIG. 1.

The tape 118 may be of various types, such as single sided, double sided, etc. However, single sided cloth tape with a cover and pull-tab 120 may be used where the tape is sewn onto the panels with stitching 122. The stitching 122 causes the tape 118 to remain attached to the fixture guard system 100 when the system 100 is removed from the shower fixture and thereby prevents the tape 118 from remaining on the shower fixture. The cover with pull-tab 120 prevents the tape 118 from adhering to other objects or collecting debris prior to the fixture guard system 100 being installed. At the time of installation, the installer pulls the pull-tab 120 to remove the cover and expose the adhesive of the tape 118. FIG. 4 shows a side view of the fixture guard system 100 to further illustrate the position of the tape 118 along the top edge of the panel 106 and along the panel 108, which secures the fixture guard system 100 within the shower fixture.

In certain embodiments, the tape 118 may be a single sided tape. On the side with the glue, one edge of about one-quarter inch of that side may lack glue while both edges are sewn down with the stitching located about one-quarter of an inch from each edge. The backing of these certain embodiments may be such that it tears easily along the stitched lines. Thus, one continuous strip may be used and easily pulled by a pull tab without any tearing of the paper backing except at the stitched lines.

Figure 3:
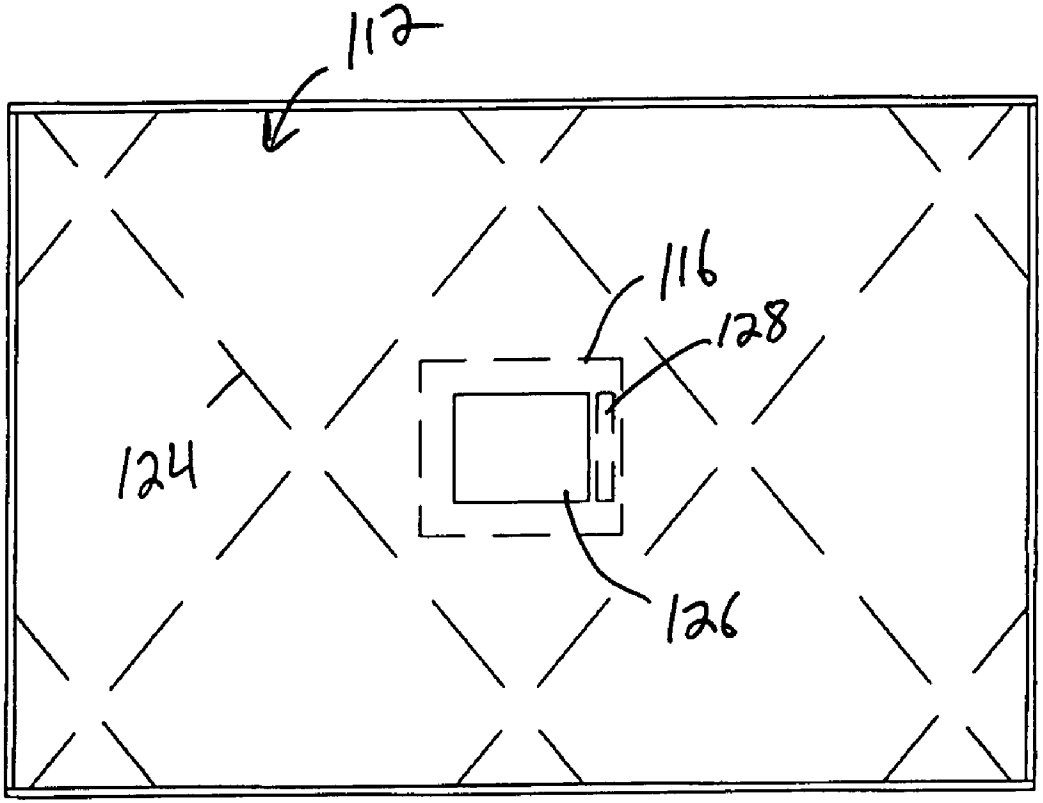
FIG. 3 is an elevational view of the floor surface of the embodiment of FIG. 1.

FIG. 3 shows the panel 112 that protects the floor of the shower fixture. The panel 112 has a surface facing outward from the shower fixture when installed that is a woven polyethylene plastic. Additionally, because various tools may fall onto this panel 112, ladders may be placed on this panel 112, and workers may stand on this panel 112, it is provided with a padding layer and a non-skid rubber layer to protect the fixture from impacts and to prevent the panel 112 from skidding so that workers standing on the panel do not fall. These two layers (not shown in FIG. 3) are described in more detail below with reference to FIG. 5. However, FIG. 3 illustrates cross-stitching 124 that is included to sew together the woven polyethylene, the padding, and the non-skid rubber to prevent the layers from sliding with respect to one another. This provides a more stable panel 112.

FIG. 3 also shows a drain flap 116 covering a drain access opening 126. The drain access opening 126 is positioned over the drain of the shower fixture so that a worker may access the drain by opening the drain flap 116. The drain flap 116 is hingedly attached to the panel 112 at a sewn hem along an edge of the drain flap 116 and is secured in a closed position by a fastener 128 which is a hook and loop fastener such as Velcro® in this embodiment. It will also be appreciated that the fastener 128 may be entirely omitted for the drain flap 116, since the floor surface of the fixture will hold the drain flap 116 in the closed position.

Figure 5:
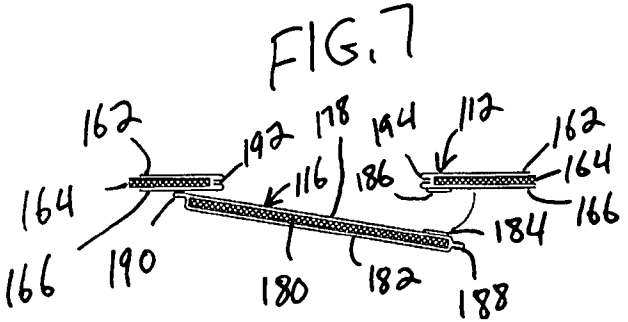
FIG. 5 is a side cross-sectional view of the embodiment of FIG. 1.

FIG. 5 shows a cross-sectional view of the fixture guard system 100, which reveals the various configurations of the panels that cover the step, floor, and rear wall of the shower fixture. The panels of FIG. 5 are shown without consistency of scale for purposes of illustrating the details of panels that protect the step and floor of the shower fixture. The combination of panels 114 that protects the step portion of the shower fixture includes a front vertical panel 130, a top horizontal panel 140, and a rear vertical panel 150.

The front panel 130 includes an outer side 132 that faces away from the shower fixture 176 and that is a flexible sheet of woven polyethylene in this embodiment. A layer of foam padding 134 is positioned behind the outer side 132 to provide cushioning to protect the shower fixture 176 from impacts. A rear side 136 is positioned behind the padding layer 134 and is a flexible sheet of woven polyethylene. A hem 138 is sewn along one edge and a hem 148 is sewn along another edge of the panel 130 to hold the padding 134 between the two flexible sheets 132, 136. Thus, the two flexible sheets 132, 136 of the panel 130 with hemmed edges 138, 148 form an enclosure that contains the padding 134. The front panel 130 may be provided with a tape strip along one or more of its edges of the rear side 136 to allow adhesion to the fixture 176.

Hem 148 also acts as a junction between the front panel 130 and the top panel 140. The hems of the embodiments shown herein are formed by edge tape that wraps over the ends of the two flexible sheets of material 132, 136 and thread stitching that passes through the edge tape and the ends of the flexible material. The edge tape provides additional strength for the hems. While sewn hems are provided in the embodiments described herein, it will be appreciated that other manners of creating a panel termination point and joining adjacent panels together is also possible, such as ultrasonic or heat welds of the plastic or other exterior panel material.

The top panel 140 includes an outer side 142 that is made of woven polyethylene. An inner foam padding layer 144, which may be thicker than then foam padding of vertical panels such as panel 130 for added protection, is placed between the outer side 142 and an inner side 146 and provides protection from impacts. The inner side 146 is a sheet of flexible rubber that provides a non-skid surface. The inner side 146 contacts the step of the shower fixture 176 and prevents slippage of the fixture guard panel 140 so that a worker may stand on the panel 140 without the panel 140 slipping to reduce the likelihood of the worker falling. Cross-stitching (not shown in FIG. 5), as shown in FIG. 3, may also be used to sew together the outer side 142, padding 144, and inner side 146 to prevent the padding 144 and outer side 142 from slipping relative to the inner side 146.

While hem 142 holds one side of the panel 140 together, another hem 158 holds the other side together. Hem 158 also acts as a junction between the top panel 140 and the rear panel 150. The rear panel includes an outer side 152 that is woven polyethylene, an inner foam padding layer 154, and a rear side 156 that is woven polyethylene. While hem 158 holds one side of the panel 150 together, another hem 168 holds the other side together. Hem 168 also acts as a junction between the rear panel 150 and the floor panel 112.

As discussed above with reference to FIG. 3, the floor panel 112 includes an outer side 162 that is a sheet of woven polyethylene. The floor panel further includes an inner padding layer 164, which may be thicker than padding layers of vertical panels, to provide protection from impacts. A bottom side 166 is a sheet of rubber that provides non-skid surface that contacts the floor of the shower fixture 176 to prevent skidding. As shown in FIG. 3, cross-stitching secures the outer side 162, padding 164, and bottom side 166 together so that the outer side 162 and padding 164 do not skid relative to the bottom side 166. While the hem 168 holds one side of the bottom panel 112 together, another hem 172 holds the other side of the bottom panel 112 together. Hem 172 also acts as a junction between the floor panel 112 and the rear panel 104.

The rear panel 104 of this embodiment is a sheet of woven polyethylene. There is no padding layer or a second sheet of woven polyethylene or rubber since the rear portion of the shower fixture typically requires less impact protection. However, this rear panel 104 may alternatively be configured to include a layer of padding and a second sheet of woven polyethylene or rubber as may be required by a particular fixture. The panel 104 of this embodiment includes a hem 174 at the termination of the panel 104 to strengthen the otherwise exposed edge of the woven polyethylene.

Figure 6:
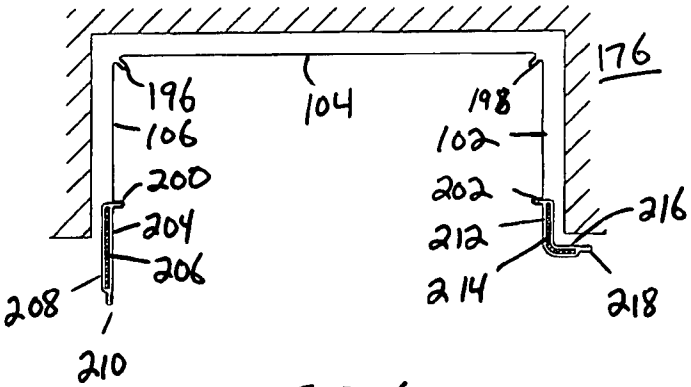
FIG. 6 is downward cross-sectional view of the embodiment of FIG. 1.

FIG. 6 shows a top view of the fixture guard system 100, showing the interconnection of the side panels 102, 106 to the rear panel 104 and to the corner panels 108 and 110. The rear panel 104 is joined to the side panel 102 at hem junction 198 and is jointed to the side panel 106 at hem junction 196. As can be seen, the side panels 102 and 106 are also a sheet of woven polyethylene and do not include a layer of padding nor a second sheet of woven polyethylene or rubber. As with the rear portion of the shower fixture, the two side portions also require less impact protection, but these side panels 102, 106 may alternatively be configured to include a layer of padding and a second sheet of woven polyethylene or rubber as may be required by the particular fixture. The side panel 102 is joined to the corner panel 110 by hem junction 202 while the side panel 106 is joined to the corner panel 108 by hem junction 200.

The corner panel 108 includes an outer side 204 that is woven polyethylene, an inner layer of padding 206 to protect the corner from impacts, and a back side 208 that is also woven polyethylene. In addition to the hem 200 holding one side of the corner panel 108 together, another hem 210 closes the other side. As discussed below in relation to the corner panel 110, these corner panels are flexible for form fitting to the shower fixture by allowing the installer to bend the corner panels 108, 110 around the corner of the shower fixture. Attachment tape of the corner panels 108, 110 as shown in FIG. 2 then adheres to the shower fixture to help hold the fixture guard system 100 in place.

The corner panel 110 includes an outer side 212 that is woven polyethylene, an inner layer of padding 214 to protect the corner from impacts, and a back side 216 that is also woven polyethylene. In addition to the hem 202 holding one side of the corner panel 110 together, another hem 218 closes the other side. As can be seen, the corner panel 110 is flexible for form fitting to the shower fixture by bending around the corner.

Figure 7:
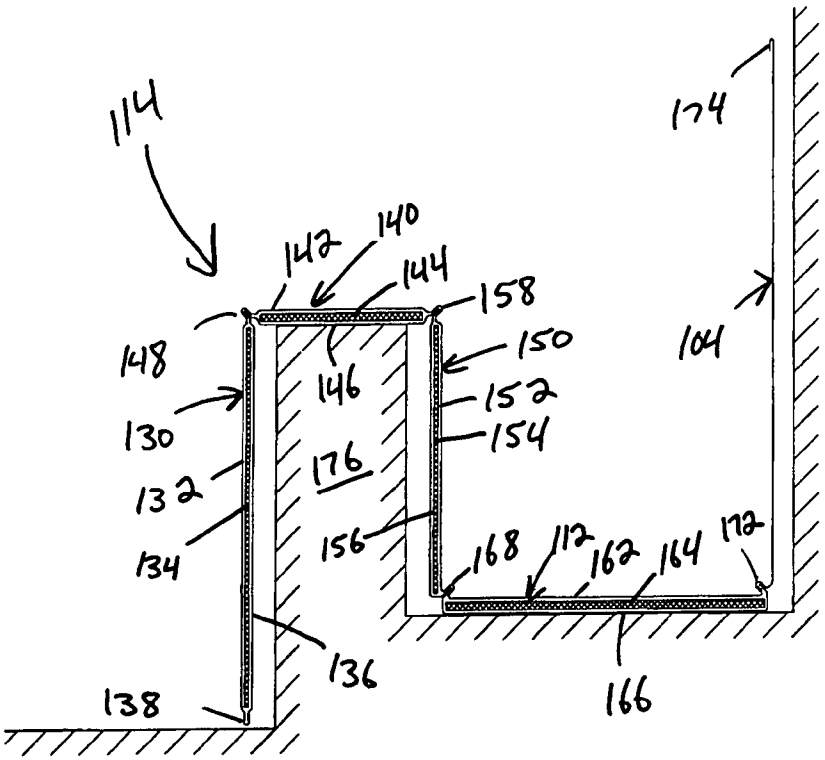
FIG. 7 is a side cross-sectional view of the floor surface of the embodiment of FIG. 1.

FIG. 7 shows a cross-section of the floor panel 112 through the drain flap 116. The drain flap 116 includes an upper side 178 that is a sheet of woven polyethylene, an inner padding layer 180 for protection from impacts, and a lower side 182 that is a sheet of rubber for adding to the non-skid characteristic of the floor panel 112. The drain flap 116 is held together at one end by a hem 190 that ties the sheet 178 to the sheet 182 and also ties sheets 178 and 182 to sheet 166 of the floor panel 116 to provide a hinged connection. Another hem 188 holds the other end together.

A fastener 128, shown in FIG. 3, may be included to hold the drain flap 116 shut. In this embodiment, the fastener 128 is a hook and loop fastener, such as Velcro® tape, where one side 184 of the fastener 128 is mounted to the upper side 178 of the drain flap 116 and the other side 186 is mounted to the bottom side 166 of the floor panel 112. Thus, the drain flap 116 rotates downward toward the drain when the drain flap 116 is opened by a worker. As an alternative for this fixture guard system, as well as the other systems described below, the drain flap 116 and fastener 128 may be positioned atop the floor panel 112 such that the drain flap 116 opens upwardly. However, the drain flap 116 is more susceptible to being kicked upward to expose the drain area of the fixture in this position. As discussed above, the fastener 128 may be omitted as the floor of the fixture will hold the flap 116 in the closed position. As can also be seen in FIG. 7, the opening through the top side 162, padding 164, and bottom side 166 may be closed at the edges by hems 192, 194.

Figure 8:
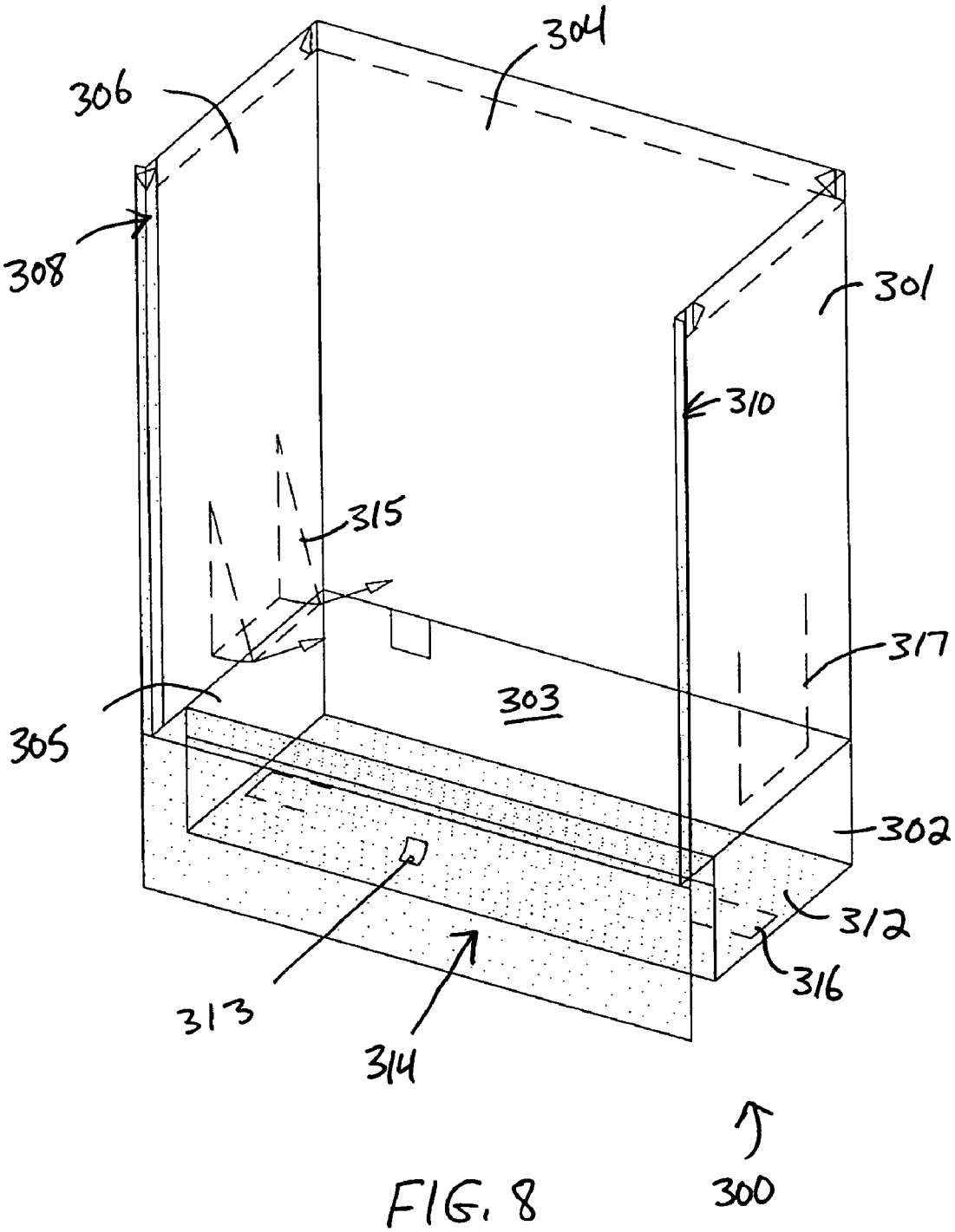
FIG. 8 is a front perspective view of another embodiment of a fixture guard system for a shower-tub combination having various embodiments of fixture guard panels.

FIG. 8 shows one embodiment of a fixture guard system 300 that includes multiple flexible fixture guard panels to provide protection for a shower-tub combination fixture. A first flexible fixture guard panel 301 protects an upper side of the shower-tub fixture, a second flexible fixture guard panel 302 protects a lower side of the shower-tub fixture, a third flexible fixture guard panel 304 protects an upper rear side of the shower-tub fixture, a fourth flexible panel 303 protects a lower rear side of the shower-tub fixture, a fifth flexible panel 306 protects another upper side of the shower-tub fixture, and a sixth flexible panel 305 protects another lower side of the shower-tub fixture. A seventh flexible panel 312 protects a floor of the shower-tub fixture while providing a drain access flap 316. Flexible panels 308 and 310 protect the front vertical corners of the shower-tub fixture while a combination of flexible panels 314 protects a front step of the shower-tub fixture.

FIG. 8 also shows access flaps 315 and 317 of the upper side panels 306 and 301, respectively. These access flaps allow a worker to access the area where the water controls and/or spigot are likely positioned on the shower-tub fixture, regardless of which side. These access flaps 315, 317 are discussed below with reference to FIG. 11. Also shown in FIG. 8, the combination of panels 314 may include a flap with eyelet 313 which allows this portion of the fixture guard 300 to be attached to a string that can be used to partially lift the fixture guard 300 out of the tub portion of the shower-tub fixture so that water can be placed within the tub portion, underneath the fixture guard 300, for testing purposes while the fixture guard 300 remains positioned on the fixture.

Figure 9:
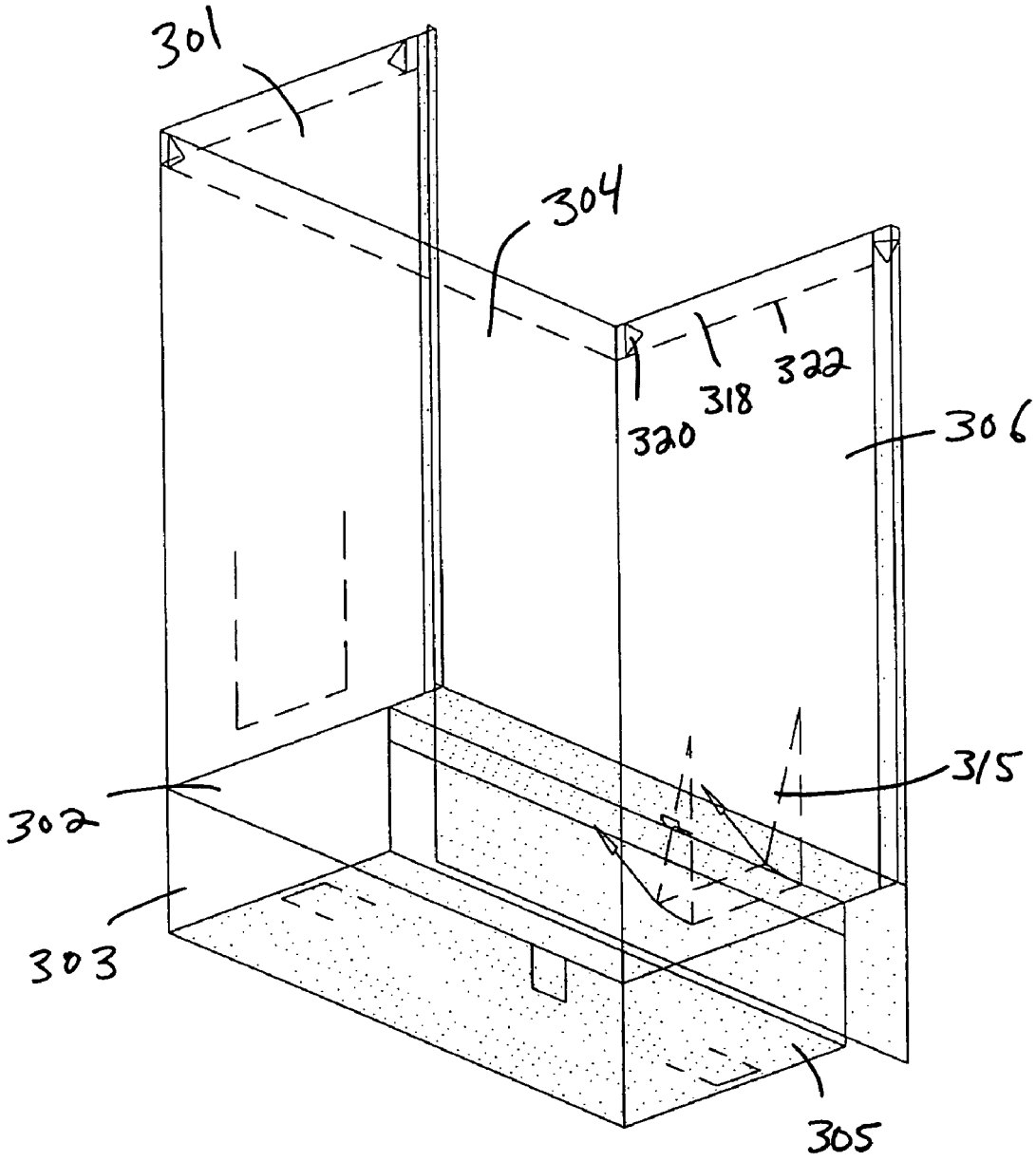
FIG. 9 is a rear perspective view of the embodiment of FIG. 8.

FIG. 9 shows a rear view of the fixture guard system 300. From this view, attachment tape 318 can be seen extending horizontally along the upper edges of the panels 304, 306 and vertically along the panel 308. Tape 318 is shown extending horizontally along the top edge of panel 301 in FIG. 8. This tape 118 has an adhesive surface facing outward from the fixture guard panels to which it is attached so that the tape can adhere to the walls of the shower-tub fixture to hold the fixture guard system 300 in place.

As with the previously discussed embodiment, the tape 318 may be of various types, such as single sided, double sided, etc. However, single sided tape with a cover and pull-tab 320 may be used where the tape is sewn onto the panels with stitching 322. The stitching 322 causes the tape 318 to remain attached to the fixture guard system 300 when the system 300 is removed from the shower-tub fixture and thereby prevents the tape 318 from remaining on the shower-tub fixture. The cover with pull-tab 320 prevents the tape 318 from adhering to other objects or collecting debris prior to the fixture guard system 300 being installed. At the time of installation, the installer pulls the pull-tab 320 to remove the cover and expose the adhesive of the tape 318.

Figure 11:
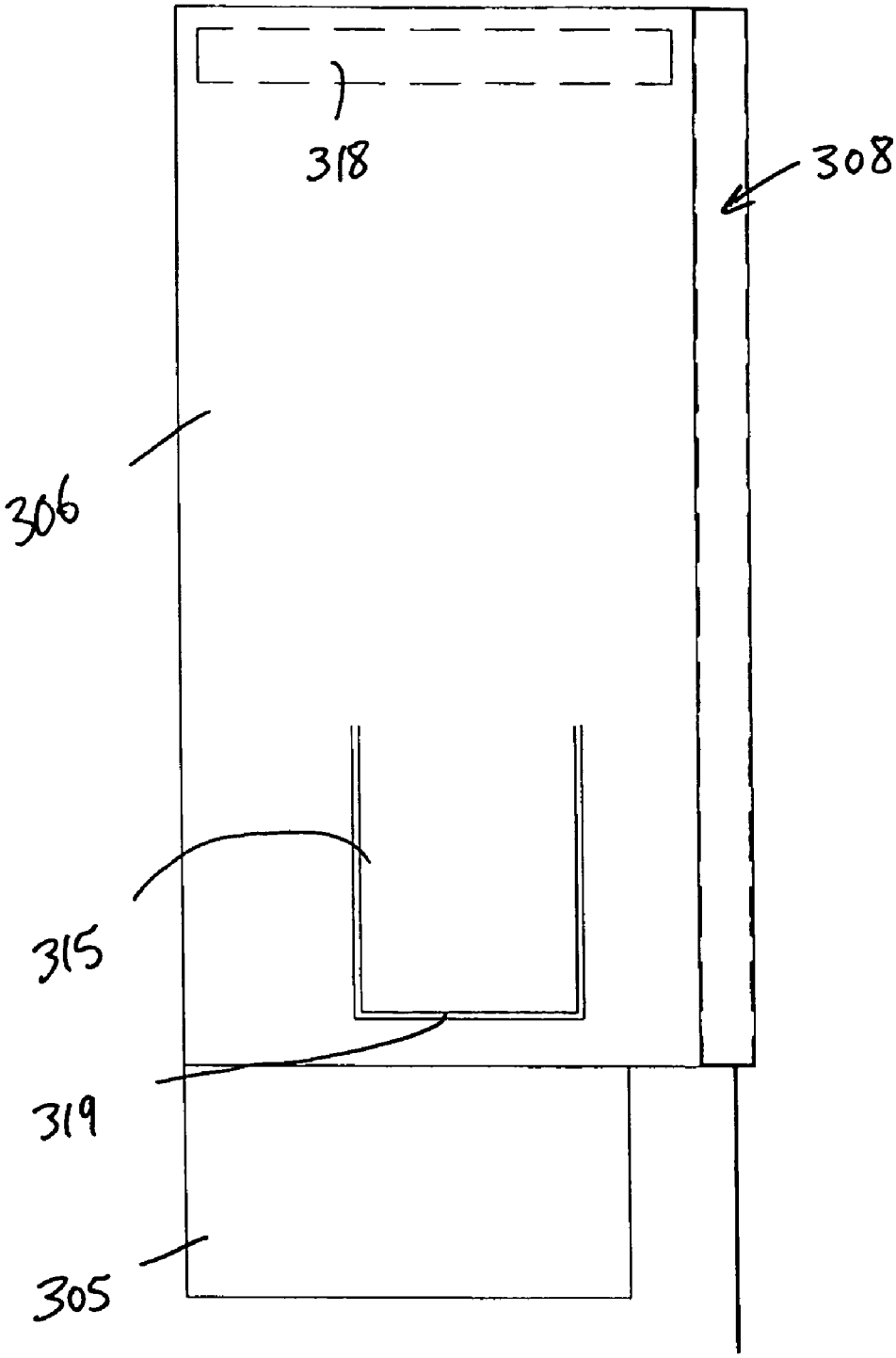
FIG. 11 is a side elevational view of the embodiment of FIG. 8.

FIG. 11 shows a side view of the fixture guard system 300 to further illustrate the position of the tape 318 along the top edge of the panel 306 and along the panel 308, which secures the fixture guard system 300 within the shower-tub fixture. FIG. 11 also shows the access flap 315 which has hemmed edges. Additionally, a fastener 319 such as a hook and loop fastener is present to secure the access flap 315. Access flap 317 is configured in the same manner as flap 315, with hemmed edges and a fastener.

Figure 10:
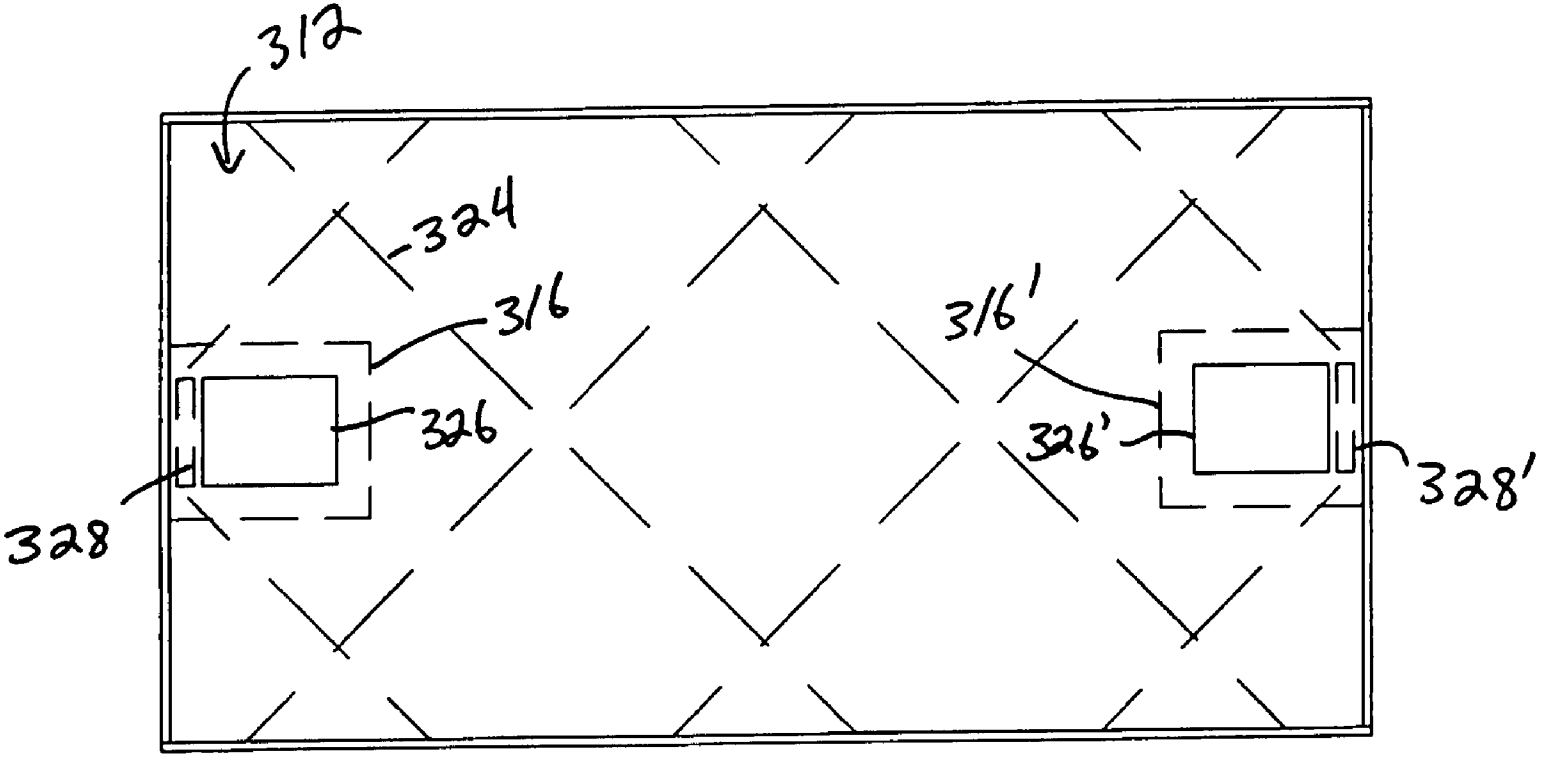
FIG. 10 is an elevational view of the floor surface of the embodiment of FIG. 8.

FIG. 10 shows the panel 312 that protects the floor of the shower fixture. The panel 312 has a surface facing outward from the shower fixture when installed that is a woven polyethylene plastic. Additionally, because various tools may fall onto this panel 312, ladders may be placed on this panel 312, and workers may stand on this panel 312, it is provided with a padding layer and a non-skid rubber layer to protect the fixture from impacts and to prevent skids to reduce the likelihood of falls. These two layers (not shown in FIG. 10) are described in more detail below with reference to FIG. 12. However, FIG. 10 illustrates cross-stitching 324 that is included to sew together the woven polyethylene, the padding, and the non-skid rubber to prevent the layers from sliding with respect to one another. This provides a more stable panel 312.

FIG. 10 also shows drain flaps 316, 316' covering drain access openings 326, 326'. As the location of the drain 326, 326' may be on either side of the tub, the fixture guard panel 312 is provided with the drain flaps 326, 326' on both sides so that the drain will be accessible regardless of which side it is located. The drain access openings 326, 326' are positioned over the drain of the shower-tub fixture so that a worker may access the drain by opening the drain flap 316. The drain flap 316 is hingedly attached to the panel 312 at a sewn hem along an edge of the drain flap 316 and is secured in a closed position by a fastener 328 which is also a hook and loop fastener such as Velcro® in this embodiment. It will also be appreciated that the fastener 328 may be entirely omitted for the drain flap 316, 316', since the floor surface of the fixture will hold the drain flap 316, 316' in the closed position.

Figure 12:
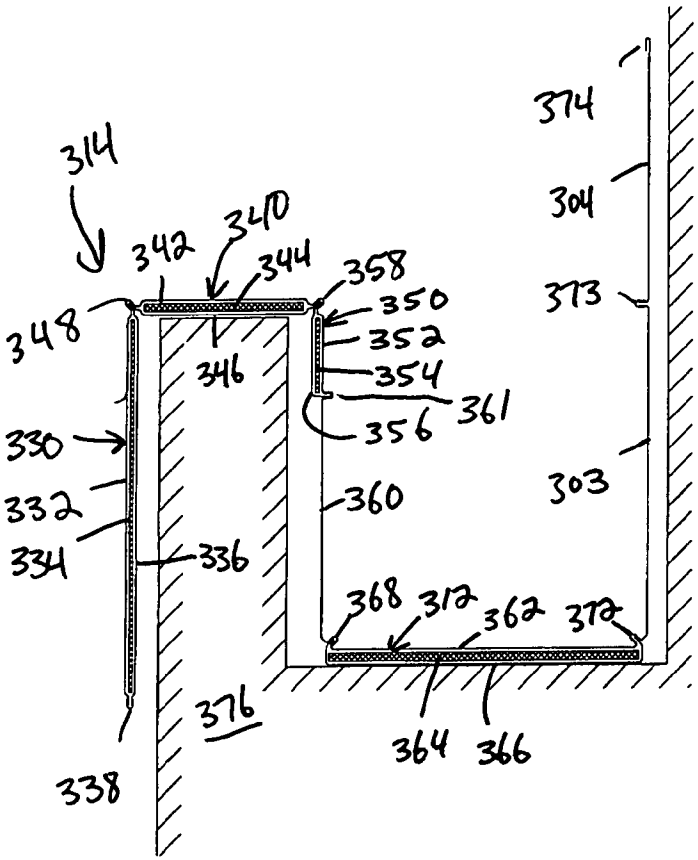
FIG. 12 is a side cross-sectional view of the embodiment of FIG. 8.

FIG. 12 shows a cross-sectional view of the fixture guard system 300, which reveals the various configurations of the panels that cover the step, floor, and rear wall of the shower-tub fixture. The panels of FIG. 12 are shown without consistency of scale for purposes of illustrating the details of panels that protect the step and floor of the shower-tub fixture. The combination of panels 314 that protects the step portion of the shower-tub fixture includes a front vertical panel 330, a top horizontal panel 340, an upper rear vertical panel 350, and a lower rear vertical panel 360.

The front panel 330 includes an outer side 332 that faces away from the shower-tub fixture 376 and that is a flexible sheet of woven polyethylene in this embodiment. A layer of foam padding 334 is positioned behind the outer side 332 to provide cushioning to protect the shower-tub fixture 376 from impacts. A rear side 336 is positioned behind the padding layer 334 and is a flexible sheet of woven polyethylene. A hem 338 is sewn along one edge and a hem 348 is sewn along another edge of the panel 330 to hold the padding 334 between the two flexible sheets 332, 336. Thus, the two flexible sheets 332, 336 of the panel 330 with hemmed edges 338, 348 form an enclosure that contains the padding 334. The front panel 330 may be provided with a tape strip along one or more of its edges of the rear side 336 to allow adhesion to the fixture 376.

Hem 348 also acts as a junction between the front panel 330 and the top panel 340. As discussed above in relation to the previous embodiment, the hems of the embodiments shown herein are formed by edge tape that wraps over the ends of the two flexible sheets of material 332, 336 and thread stitching that passes through the edge tape and the ends of the flexible material.

The top panel 340 includes an outer side 342 that is made of woven polyethylene. An inner foam padding layer 344, which may be thicker than then foam padding of vertical panels such as panel 330 for added protection, is placed between the outer side 342 and an inner side 346 and provides protection from impacts. The inner side 346 is a sheet of flexible rubber that provides a non-skid surface. The inner side 346 contacts the step of the shower-tub fixture 376 and prevents slippage of the fixture guard panel 340 so that a worker may stand on the panel 340 without the panel 340 slipping and to reduce the likelihood of the worker falling. Cross-stitching (not shown in FIG. 12), as shown in FIG. 10, may also be used to sew together the outer side 342, padding 344, and inner side 346 to prevent the padding 344 and outer side 342 from slipping relative to the inner side 346.

While hem 342 holds one side of the panel 340 together, another hem 358 holds the other side together. Hem 358 also acts as a junction between the top panel 340 and the upper rear panel 350. The upper rear panel 350 includes an outer side 352 that is woven polyethylene, an inner foam padding layer 354, and a rear side 356 that is woven polyethylene. While hem 358 holds one side of the panel 350 together, another hem 361 holds the other side together. Hem 361 also acts as a junction between the upper rear panel 350 and the lower rear panel 360.

The lower rear panel 360 is a sheet of woven polyethylene. This panel 360 lacks padding and a second sheet of polyethylene or rubber because this lower rear portion of the step of the shower-tub fixture requires less protection from impacts. However, this panel 360 could be provided with padding and a second layer of polyethylene and/or rubber to address the needs of a particular fixture. A hem 168 acts as a junction between the lower rear panel 360 and the floor panel 312.

As discussed above with reference to FIG. 10, the floor panel 312 includes an outer side 362 that is a sheet of woven polyethylene. The floor panel 312 further includes an inner padding layer 364, which may be thicker than padding layers of vertical panels, to provide protection from impacts. A bottom side 366 is a sheet of rubber that provides non-skid surface that contacts the floor of the shower-tub fixture 376 to prevent skidding. As shown in FIG. 10, cross-stitching secures the outer side 362, padding 364, and bottom side 366 together so that the outer side 362 and padding 364 do not skid relative to the bottom side 366. While the hem 368 holds one side of the bottom panel 312 together, another hem 372 holds the other side of the bottom panel 312 together. Hem 372 also acts as a junction between the floor panel 312 and the lower rear panel 303.

The lower rear panel 303 of this embodiment is a sheet of woven polyethylene. There is no padding layer or a second sheet of woven polyethylene or rubber since the rear portion of the shower fixture typically requires less impact protection. However, this lower rear panel 303 may alternatively be configured to include a layer of padding and a second sheet of woven polyethylene or rubber as may be required by a particular fixture. The panel 303 of this embodiment includes a hem 373 that acts as a junction between the lower rear panel 303 and the upper rear panel 304.

The upper rear panel 304 of this embodiment is also a sheet of woven polyethylene. There is no padding layer or a second sheet of woven polyethylene or rubber since the rear portion of the shower fixture typically requires less impact protection. However, this upper rear panel 304 may also alternatively be configured to include a layer of padding and a second sheet of woven polyethylene or rubber as may be required by a particular fixture. The panel 304 of this embodiment includes a hem 374 at the termination of the panel 304 to strengthen the otherwise exposed edge of the woven polyethylene.

Figure 13:
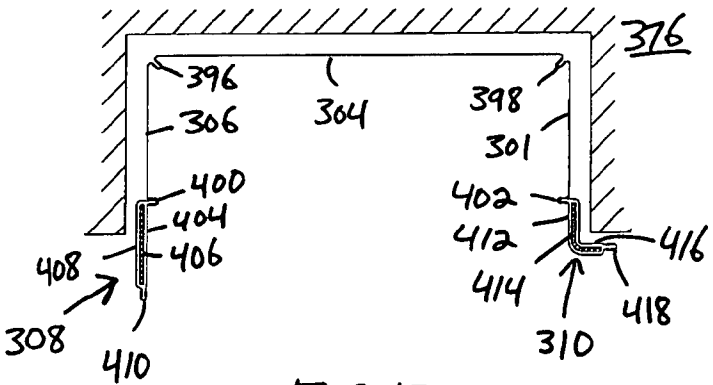
FIG. 13 is downward cross-sectional view of the embodiment of FIG. 8.

FIG. 13 shows a top view of the fixture guard system 300, showing the interconnection of the upper side panels 301, 306 to the upper rear panel 304 and to the corner panels 308 and 310. The rear panel 304 is joined to the side panel 301 at hem junction 398 and is jointed to the side panel 306 at hem junction 396. As can be seen, the side panels 301 and 306 are also a sheet of woven polyethylene and do not include a layer of padding nor a second sheet of woven polyethylene or rubber. As with the rear portion of the shower fixture, the two side portions also require less impact protection, but these side panels 301, 306 may alternatively be configured to include a layer of padding and a second sheet of woven polyethylene or rubber as may be required by the particular fixture. The side panel 301 is joined to the corner panel 310 by hem junction 402 while the side panel 306 is joined to the corner panel 308 by hem junction 400.

The corner panel 308 includes an outer side 404 that is woven polyethylene, an inner layer of padding 406 to protect the corner from impacts, and a back side 408 that is also woven polyethylene. In addition to the hem 400 holding one side of the corner panel 308 together, another hem 410 closes the other side. As discussed below in relation to the corner panel 310, these corner panels are flexible for form fitting to the shower fixture by allowing the installer to bend the corner panels 308, 310 around the corner of the shower-tub fixture. Attachment tape of the corner panels 308, 310 as shown in FIG. 9 then adheres to the shower-tub fixture to help hold the fixture guard system 300 in place.

The corner panel 310 includes an outer side 412 that is woven polyethylene, an inner layer of padding 414 to protect the corner from impacts, and a back side 416 that is also woven polyethylene. In addition to the hem 402 holding one side of the corner panel 310 together, another hem 418 closes the other side. As can be seen, the corner panel 310 is flexible for form fitting to the shower fixture by bending around the corner.

Figure 14:
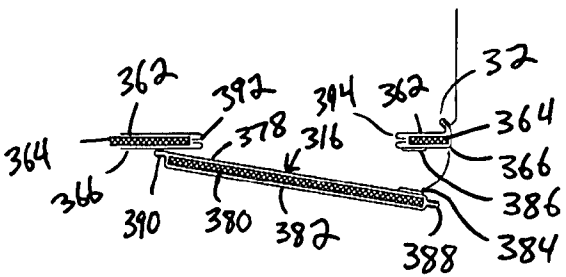
FIG. 14 is a side cross-sectional view of the floor surface of the embodiment of FIG. 8.

FIG. 14 shows a cross-section of the floor panel 312 through the drain flap 316. The drain flap 316 includes an upper side 378 that is a sheet of woven polyethylene, an inner padding layer 380 for protection from impacts, and a lower side 382 that is a sheet of rubber for adding to the non-skid characteristic of the floor panel 312. The drain flap 316 is held together at one end by a hem 390 that ties the sheet 378 to the sheet 382 and also ties sheets 378 and 382 to sheet 366 of the floor panel 316 to provide a hinged connection. Another hem 388 holds the other end together.

A fastener 328, shown in FIG. 10, may be included to hold the drain flap 316 shut. In this embodiment, the fastener 328 is a hook and loop fastener, such as Velcro® tape, where one side 384 of the fastener 328 is mounted to the upper side 378 of the drain flap 316 and the other side 386 is mounted to the bottom side 366 of the floor panel 312. Thus, the drain flap 316 rotates downward toward the drain when the drain flap 316 is opened by a worker. As discussed above, the fastener 328 may be omitted as the floor of the fixture will hold the flap 316 in the closed position. As can also be seen in FIG. 14, the opening through the top side 362, padding 364, and bottom side 366 may be closed at the edges by hems 392, 394.

Figure 15:
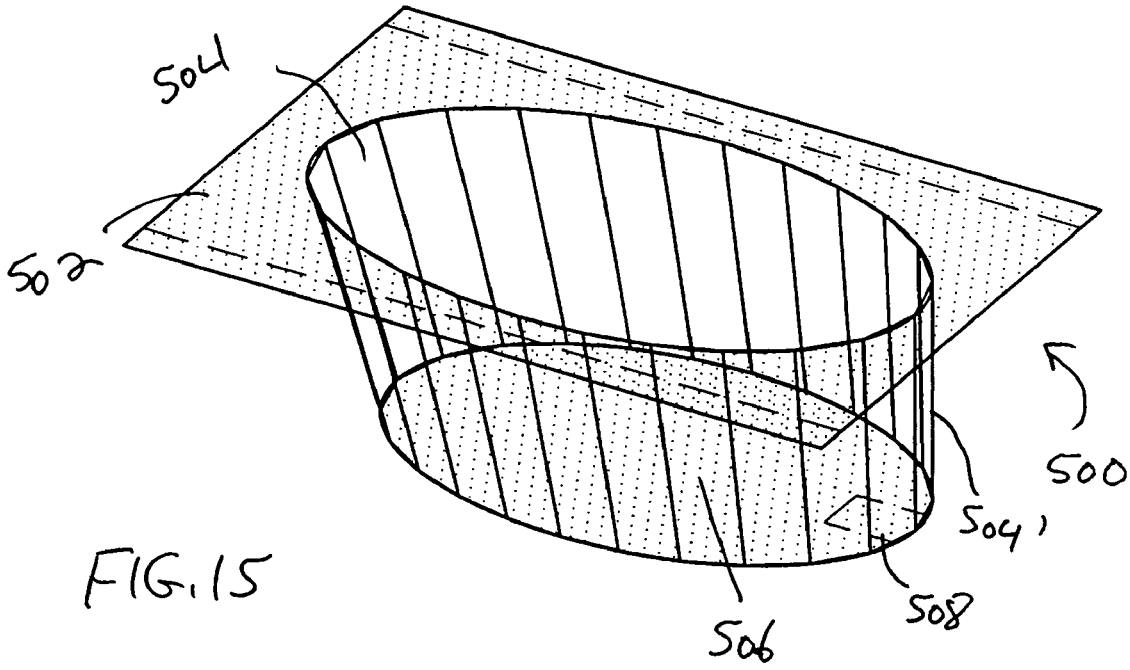
FIG. 15 is a top perspective view of another embodiment of a fixture guard system for a tub having various embodiments of fixture guard panels.

FIG. 15 shows one embodiment of a fixture guard system 500 that includes multiple flexible fixture guard panels to provide protection for a tub fixture. A first flexible fixture guard panel 502 protects a top of the tub fixture, a second flexible panel 504 protects a side of the tub fixture, and a third flexible panel 504' protects another side of the tub fixture. A fourth flexible panel 506 protects a floor of the tub fixture while providing a drain access flap 508.

Figure 16:
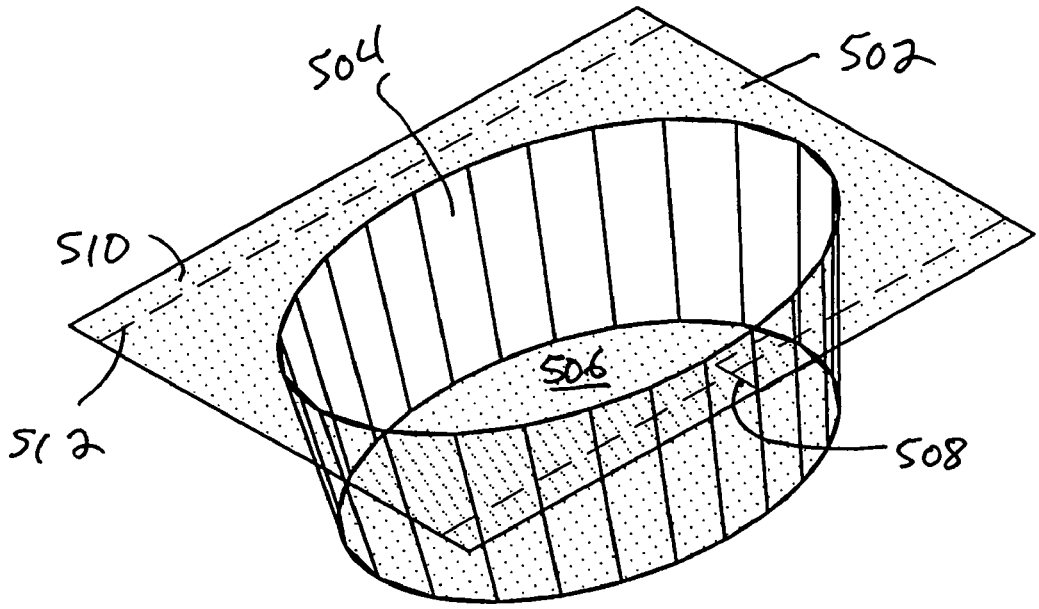
FIG. 16 is a bottom perspective view of the embodiment of FIG. 15.

FIG. 16 shows a bottom view of the fixture guard system 500. From this view, a drain flap 508 on bottom panel 506 can be seen as can attachment tape 510 extending horizontally along the outer edges of the underside of the top panel 502. This tape 510 has an adhesive surface facing outward from the fixture guard panels to which it is attached so that the tape can adhere to the top surface of the tub fixture to hold the fixture guard system 500 in place.

As described above for the previous embodiments, the tape 510 may be of various types, such as single sided, double sided, etc. However, single sided tape with a cover and pull-tab may be used where the tape is sewn onto the panels with stitching 512. The stitching 512 causes the tape 510 to remain attached to the fixture guard system 500 when the system 500 is removed from the tub fixture and thereby prevents the tape 510 from remaining on the tub fixture. The cover with pull-tab prevents the tape 510 from adhering to other objects or collecting debris prior to the fixture guard system 500 being installed. At the time of installation, the installer pulls the pull-tab to remove the cover and expose the adhesive of the tape 510.

Figure 18:
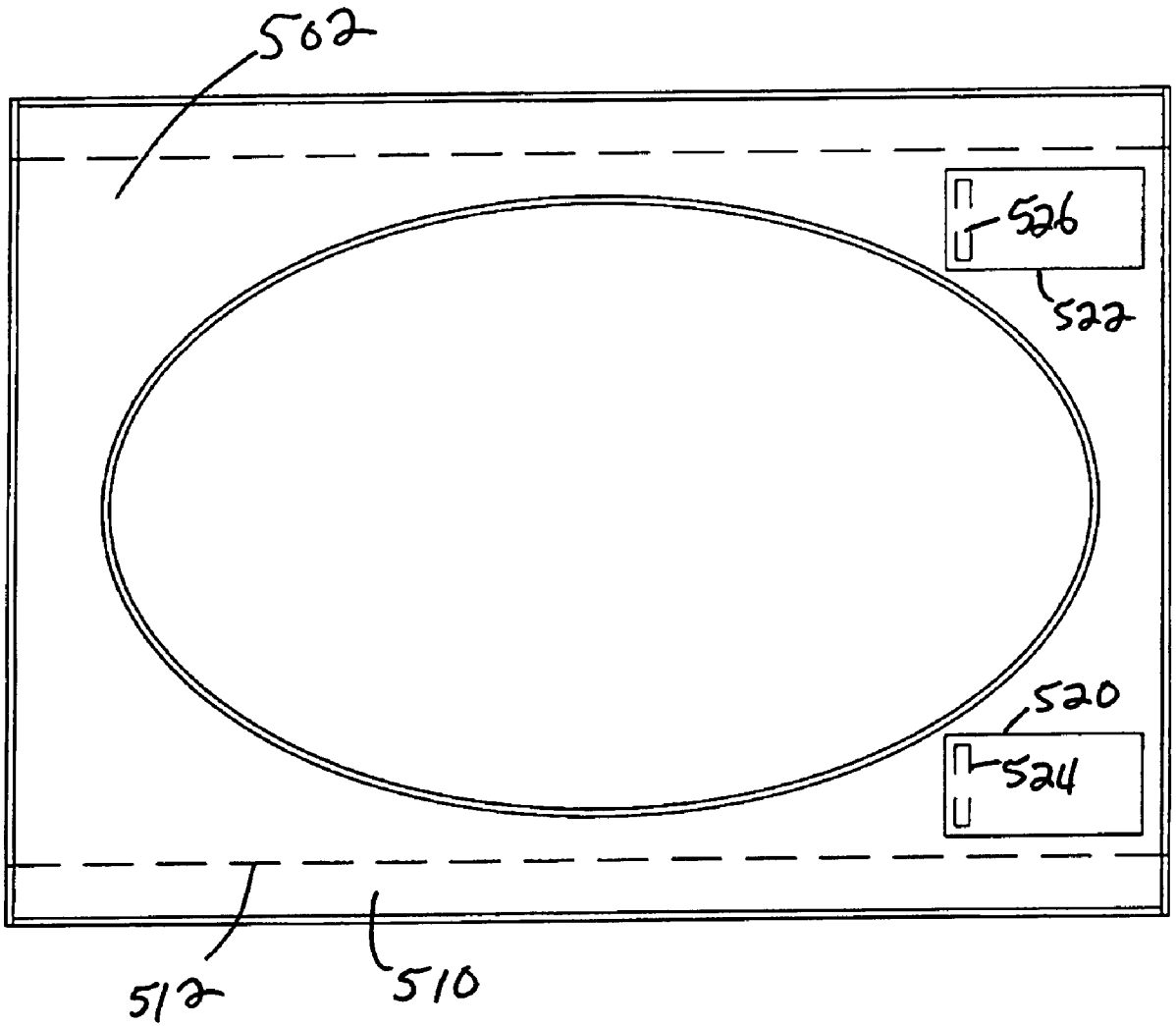
FIG. 18 is a downward elevational view of the embodiment of FIG. 15.

FIG. 18 shows a top view of the fixture guard system 500 to further illustrate the position of the tape 510 and stitching 512 along the outer edges of the underside of panel 502, which secures the fixture guard system 500 within the tub fixture. FIG. 18 also shows additional flaps 520 and 522 provided on the top panel 502 to provide access to the water controls of the tub regardless of the side they are positioned on. Fasteners 524, 526 are provided for the flaps 520, 522 to secure them in the closed position. It will be appreciated that these flaps 520, 522 may be positioned as is necessary to accommodate the fixture hardware locations. For example, the flaps 520, 522 may be positioned with their edges at a 45 degrees angle relative to the position shown.

Figure 17:
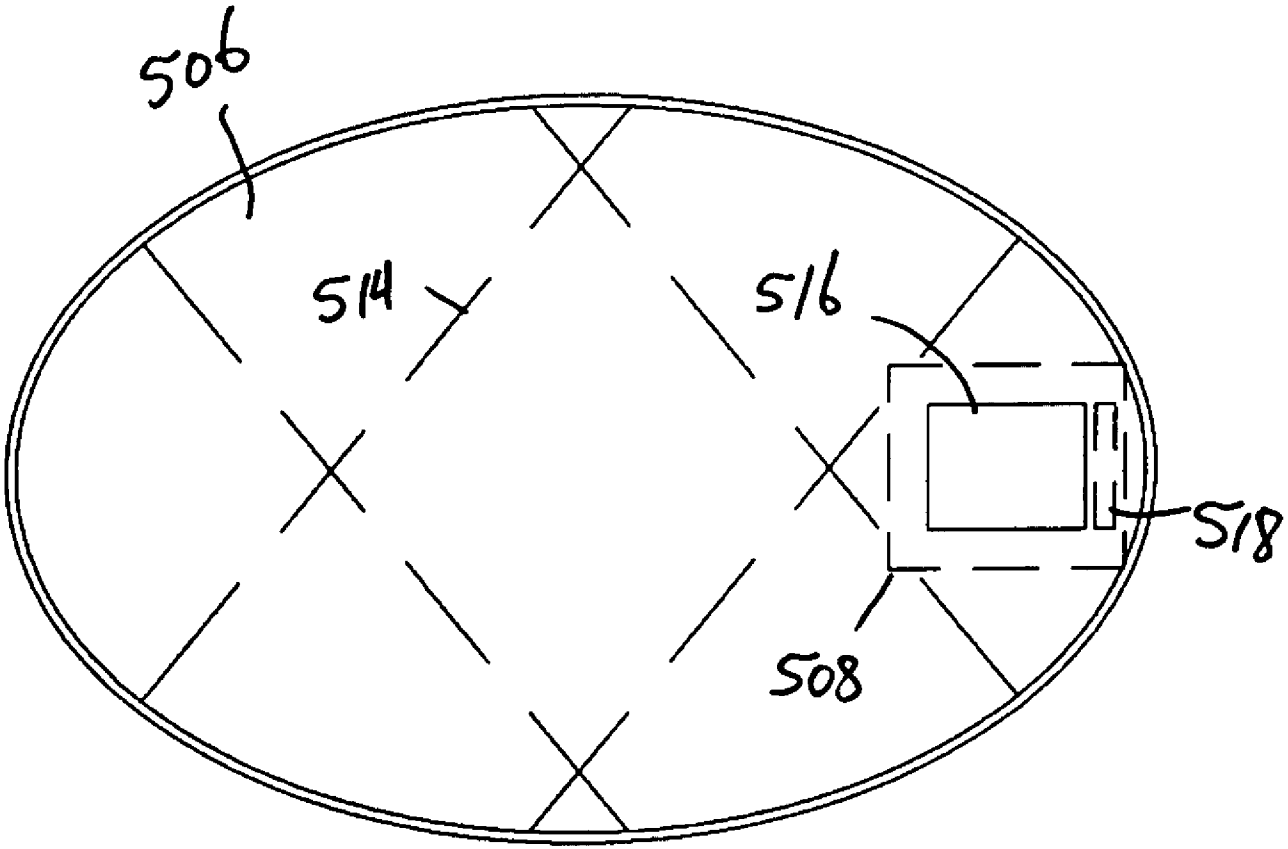
FIG. 17 is an elevational view of the floor surface of the embodiment of FIG. 15.

FIG. 17 shows the bottom panel 506 that protects the floor of the tub fixture. The panel 506 has a surface facing outward from the tub fixture when installed that is a woven polyethylene plastic. Additionally, because various tools may fall onto this panel 506, ladders may be placed on this panel 506, and workers may stand on this panel 506, it is provided with a padding layer and a non-skid rubber layer to protect the fixture from impacts and to prevent falls. These two layers (not shown in FIG. 17) are described in more detail below with reference to FIG. 19. However, FIG. 17 illustrates cross-stitching 514 that is included to sew together the woven polyethylene, the padding, and the non-skid rubber to prevent the layers from sliding with respect to one another. This provides a more stable panel 506.

FIG. 17 also shows a drain flap 508 covering a drain access opening 516. The drain access opening 516 is positioned over the drain of the tub fixture so that a worker may access the drain by opening the drain flap 508. The drain flap 508 is hingedly attached to the panel 506 at a sewn hem along an edge of the drain flap 508 and is secured in a closed position by a fastener 518, which is a hook and loop fastener such as Velcro® in this embodiment. It will also be appreciated that the fastener 518 may be entirely omitted for the drain flap 508, since the floor surface of the fixture will hold the drain flap 508 in the closed position.

Figures 19, 20:
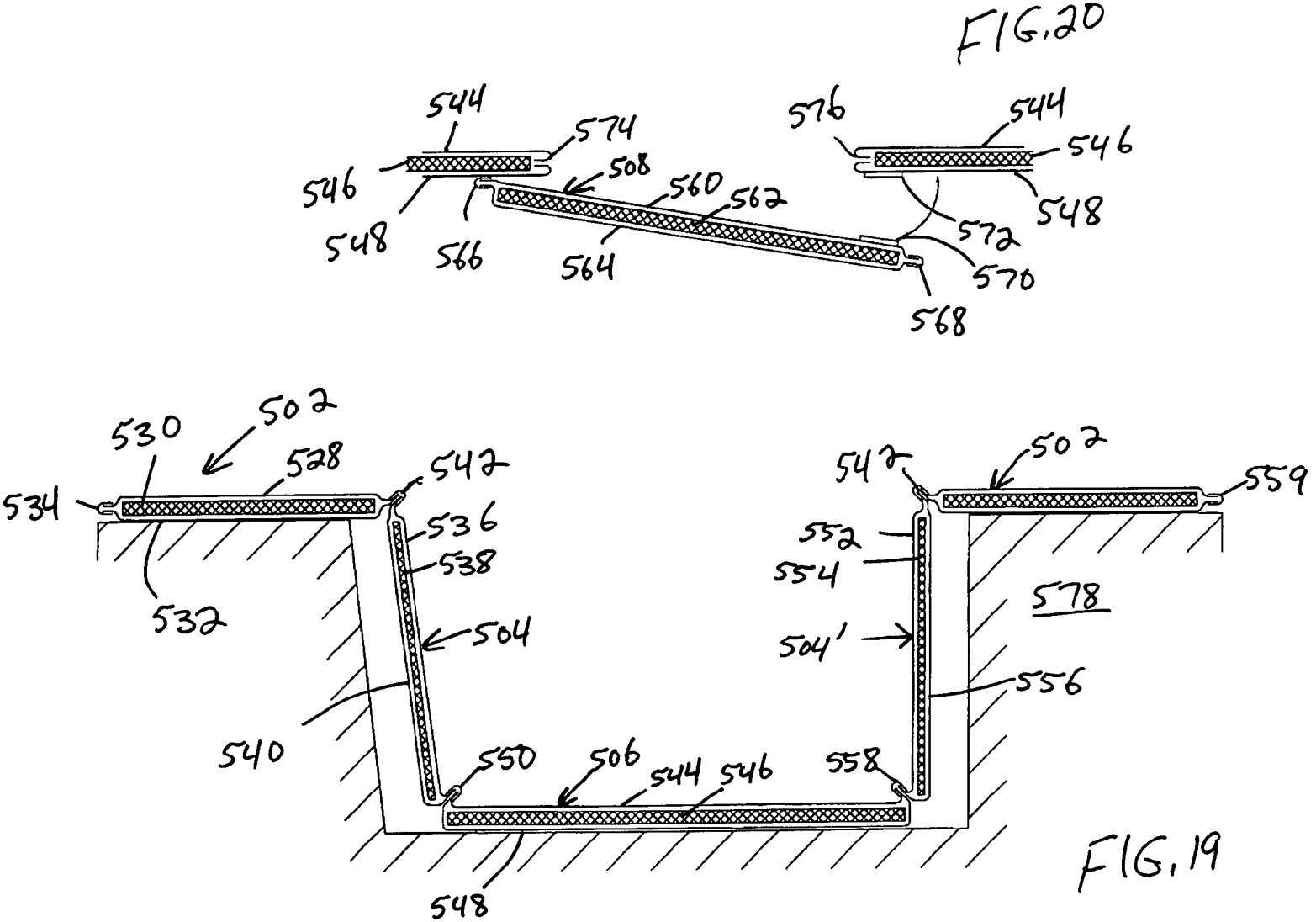
FIG. 19 is a side cross-sectional view of the embodiment of FIG. 15.
FIG. 20 is a side cross-sectional view of the floor surface of the embodiment of FIG. 15.

FIG. 19 shows a cross-sectional view of the fixture guard system 500 which reveals the various configurations of the panels that cover the top, floor, and sidewalls of the tub fixture. The panels of FIG. 19 are shown without consistency of dimension for purposes of illustrating the details of the panels.

The top panel 502 includes an outer side 528 that faces away from the tub fixture 578 and that is a flexible sheet of woven polyethylene in this embodiment. A layer of foam padding 530, which may be thicker than then foam padding of vertical panels, is positioned behind the outer side 528 to provide cushioning to protect the tub fixture 578 from impacts. An inner side 532 is a sheet of flexible rubber that provides a non-skid surface. The inner side 532 contacts the top surface of the tub fixture 578 and prevents slippage of the fixture guard panel 502 so that a worker may stand on the panel 502 without the panel 502 slipping and to reduce the likelihood of the worker falling. Cross-stitching (not shown in FIG. 19), as shown in FIG. 17, may also be used to sew together the outer side 528, padding 530, and inner side 532 to prevent the padding 530 and outer side 528 from slipping relative to the inner side 532. A hem 534 is sewn along one edge and a hem 542 is sewn along another edge of the panel 502 to hold the padding 530 between the two flexible sheets 528, 532. Thus, the two flexible sheets 528, 532 of the panel 502 with hemmed edges 534, 542 form an enclosure that contains the padding 532.

Hem 542 also acts as a junction between the top panel 502 and the side panel 504. As discussed above for the previous embodiments, the hems of the embodiments shown herein are formed by edge tape that wraps over the ends of the two flexible sheets of material 528, 532 and thread stitching that passes through the edge tape and the ends of the flexible material. The edge tape provides additional strength for the hems.

The side panel 504 includes an outer side 536 that is made of woven polyethylene. An inner foam padding layer 538 is placed between the outer side 536 and an inner side 540 and provides protection from impacts. The inner side 540 is positioned behind the padding layer 538 and is a flexible sheet of woven polyethylene.

While hem 542 holds one side of the panel 504 together, another hem 550 holds the other side together. Hem 550 also acts as a junction between the side panel 504 and the bottom panel 506. As discussed above with reference to FIG. 17, the floor panel 506 includes an outer side 544 that is a sheet of woven polyethylene. The floor panel further includes an inner padding layer 546, which may be thicker than padding layers of vertical panels, to provide protection from impacts. A bottom side 548 is a sheet of rubber that provides non-skid surface that contacts the floor of the tub fixture 578 to prevent skidding.

As shown in FIG. 17, cross-stitching secures the outer side 544, padding 546, and bottom side 548 together so that the outer side 544 and padding 546 do not skid relative to the bottom side 548. While the hem 550 holds one side of the bottom panel 506 together, another hem 558 holds the other side of the bottom panel 506 together. Hem 558 also acts as a junction between the floor panel 506 and another side panel 504'.

The side panel 504' of this embodiment includes an outer side 552 that is made of woven polyethylene. An inner foam padding layer 554 is placed between the outer side 552 and an inner side 556 and provides protection from impacts. The inner side 556 is positioned behind the padding layer 554 and is a flexible sheet of woven polyethylene. However, this side panel 504' as well as other side panels may alternatively be configured to only include a single sheet of polyethylene 552, such as for situations where a fixture requires less impact protection. The panel 504' of this embodiment includes the continuation of hem 542 around the oval tub shape to hold one end together in addition to the hem 558 at the other end. The hem 542 also acts as a junction between the side panel 504' and the top panel 502, which includes a hem 559 to hold the panel 502 together along the edge.

FIG. 20 shows a cross-section of the floor panel 506 through the drain flap 508. The drain flap 508 includes an upper side 560 that is a sheet of woven polyethylene, an inner padding layer 562 for protection from impacts, and a lower side 564 that is a sheet of rubber for adding to the non-skid characteristic of the floor panel 506. The drain flap 508 is held together at one end by a hem 566 that ties the sheet 560 to the sheet 564 and also ties sheets 560 and 564 to sheet 548 of the floor panel 506 to provide a hinged connection. Another hem 568 holds the other end together.

A fastener 518, shown in FIG. 17, may be included to hold the drain flap 508 shut. In this embodiment, the fastener 518 is a hook and loop fastener, such as Velcro® tape, where one side 570 of the fastener 518 is mounted to the upper side 560 of the drain flap 508 and the other side 572 is mounted to the bottom side 548 of the floor panel 506. Thus, the drain flap 508 rotates downward toward the drain when the drain flap 508 is opened by a worker. As discussed above, the fastener 518 may be omitted as the floor of the fixture will hold the flap 508 in the closed position. As can also be seen in FIG. 20, the opening through the top side 544, padding 546, and bottom side 548 may be closed at the edges by hems 574, 576.

Figure 21:
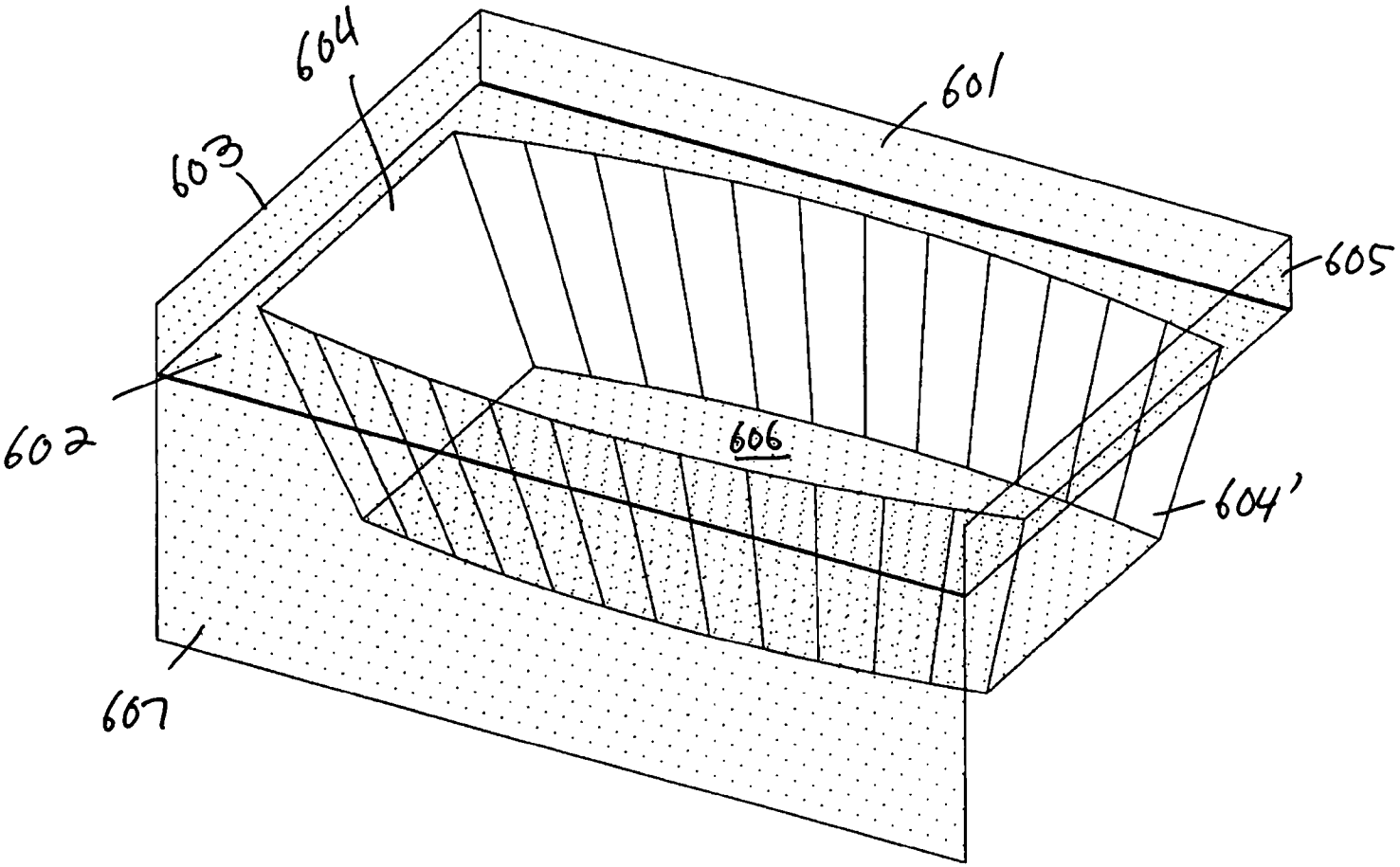
FIG. 21 is a top perspective view of another embodiment of a fixture guard system for a tub having various embodiments of fixture guard panels.

FIG. 21 shows one embodiment of a fixture guard system 600 that includes multiple flexible fixture guard panels to provide protection for a tub fixture. A first flexible fixture guard panel 602 protects a top of the tub fixture, a second flexible panel 604 protects a side of the tub fixture, a third flexible panel 604' protects another side of the tub fixture, and a fourth flexible panel 607 protects a front of the tub fixture. The fourth panel 607 may be provided with a tape strip along one or more of its edges of the inner side to allow adhesion to the fixture being protected.

Figure 22:
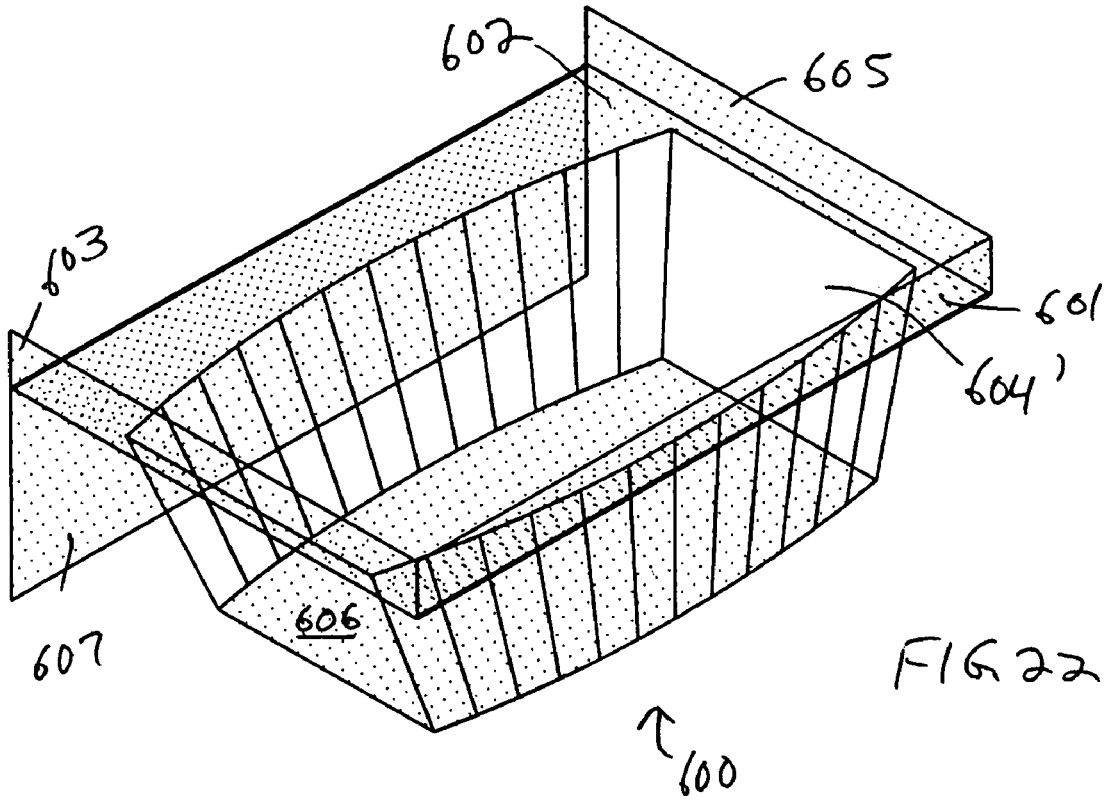
FIG. 22 is a bottom perspective view of the embodiment of FIG. 21.

A fifth flexible panel 606 protects a floor of the tub fixture while providing a drain access flap 508. A set of flexible panels 601, 603, 605 protect an outer rim of the tub fixture. FIG. 22 shows a bottom view of the fixture guard system 600. While not shown in FIGS. 21 and 22, a drain flap may be included on the bottom panel 606 and attachment tape may extend horizontally along the outer side of the set of panels 601, 603, 605. Again, the attachment tape may have an adhesive surface facing outward from the fixture guard panels to which it is attached so that the tape can adhere to the top surface of the tub fixture to hold the fixture guard system 600 in place.

As described above for the previous embodiments, the tape may be of various types, such as single sided, double sided, etc. However, single sided tape with a cover and pull-tab may be used where the tape is sewn onto the panels with stitching. The stitching causes the tape to remain attached to the fixture guard system 600 when the system 600 is removed from the tub fixture and thereby prevents the tape from remaining on the tub fixture. The cover with pull-tab prevents the tape from adhering to other objects or collecting debris prior to the fixture guard system 600 being installed. At the time of installation, the installer pulls the pull-tab to remove the cover and expose the adhesive of the tape.

Figure 23:
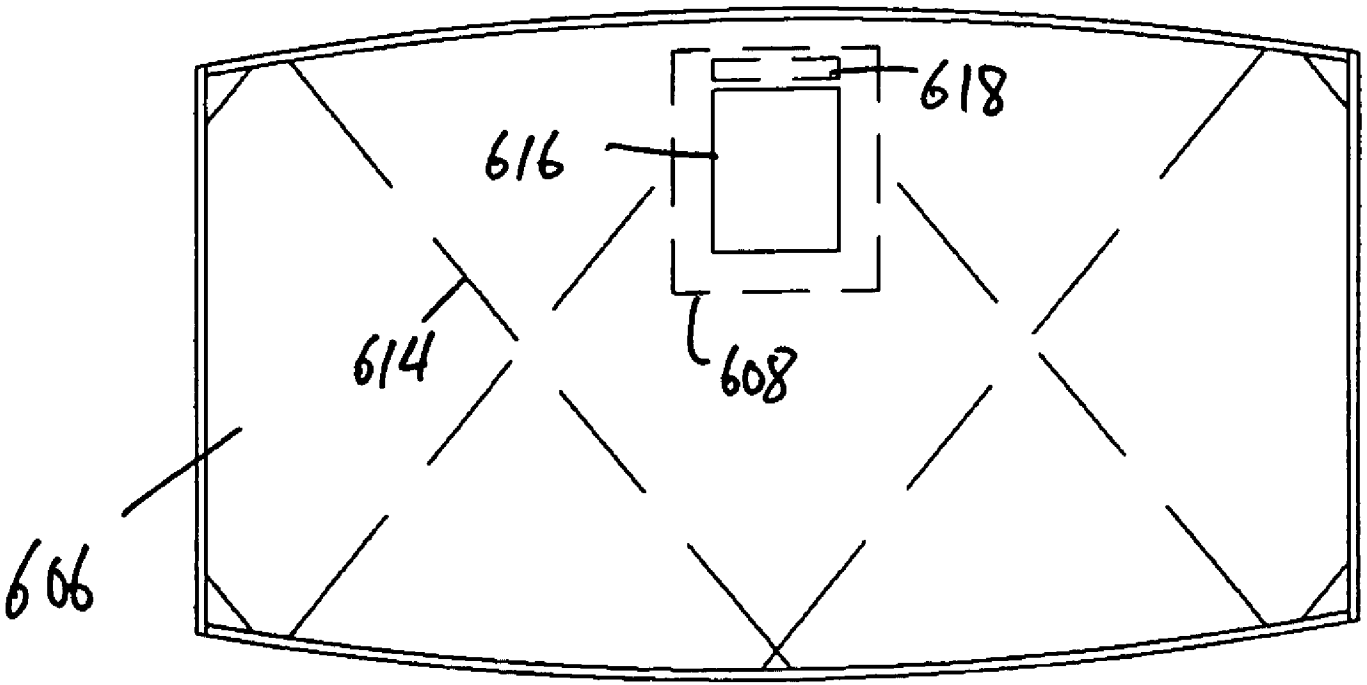
FIG. 23 is an elevational view of the floor surface of the embodiment of FIG. 21.

FIG. 23 shows the bottom panel 606 that protects the floor of the tub fixture. The panel 606 has a surface facing outward from the tub fixture when installed that is a woven polyethylene plastic. Additionally, because various tools may fall onto this panel 606, ladders may be placed on this panel 606, and workers may stand on this panel 606, it is provided with a padding layer and a non-skid rubber layer to protect the fixture from impacts and to prevent falls. These two layers (not shown in FIG. 23) are described in more detail below with reference to FIG. 25. However, FIG. 23 illustrates cross-stitching 614 that is included to sew together the woven polyethylene, the padding, and the non-skid rubber to prevent the layers from sliding with respect to one another. This provides a more stable panel 606.

FIG. 23 also shows a drain flap 608 covering a drain access opening 616. The drain access opening 616 is positioned over the drain of the tub fixture so that a worker may access the drain by opening the drain flap 608. The drain flap 608 is hingedly attached to the panel 606 at a sewn hem along an edge of the drain flap 608 and is secured in a closed position by a fastener 618, which is a hook and loop fastener such as Velcro® in this embodiment. It will be appreciated that with this embodiment, as with others, more than one drain flap may be present so as to accommodate the various alternative locations where the drain of the fixture is present. It will also be appreciated that the fastener 618 may be entirely omitted for the drain flap 608, since the floor surface of the fixture will hold the drain flap 608 in the closed position.

Figure 24:
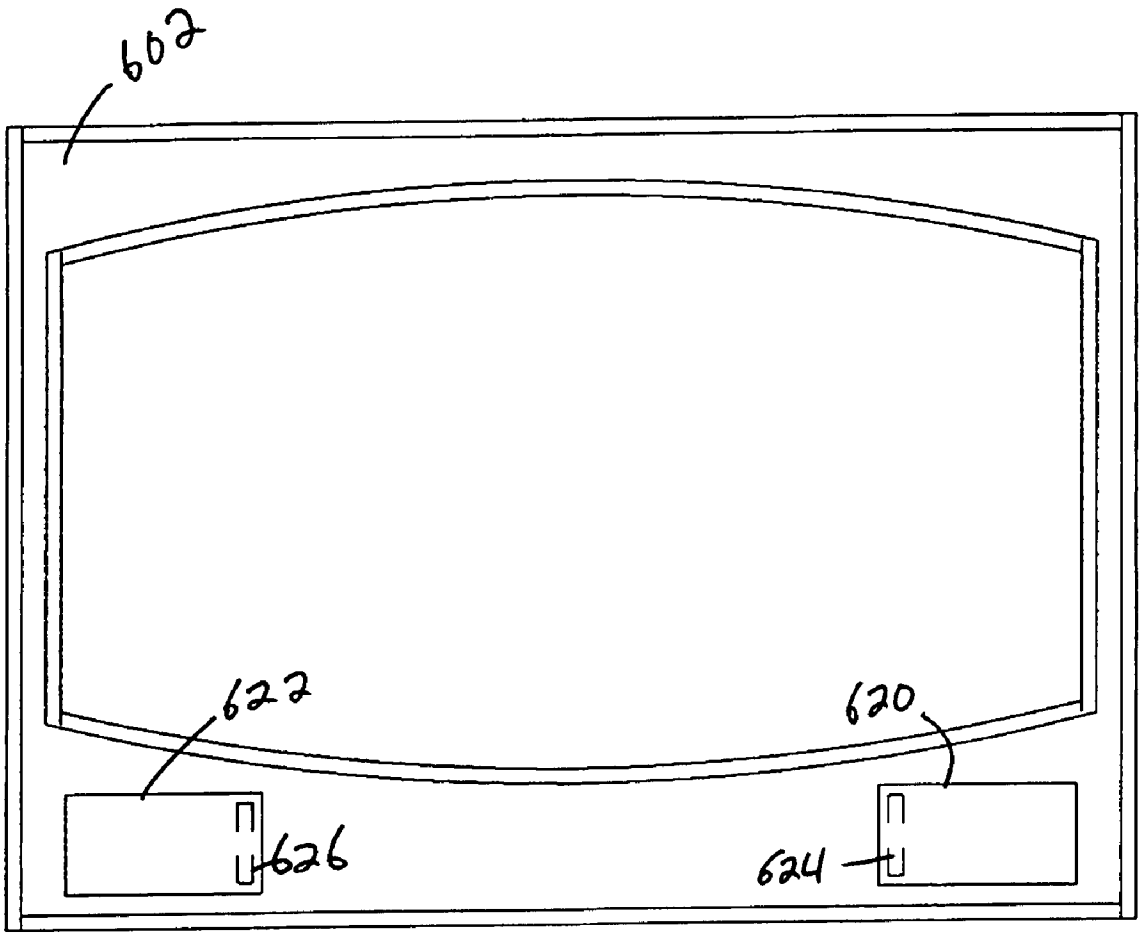
FIG. 24 is a downward elevational view of the embodiment of FIG. 21.

FIG. 24 also shows additional flaps 620 and 622 provided on the top panel 602 to provide access to the water controls of the tub regardless of the side they are positioned on. Fasteners 624, 626 are provided for the flaps 620, 626 to secure them in the closed position.

Figure 25:
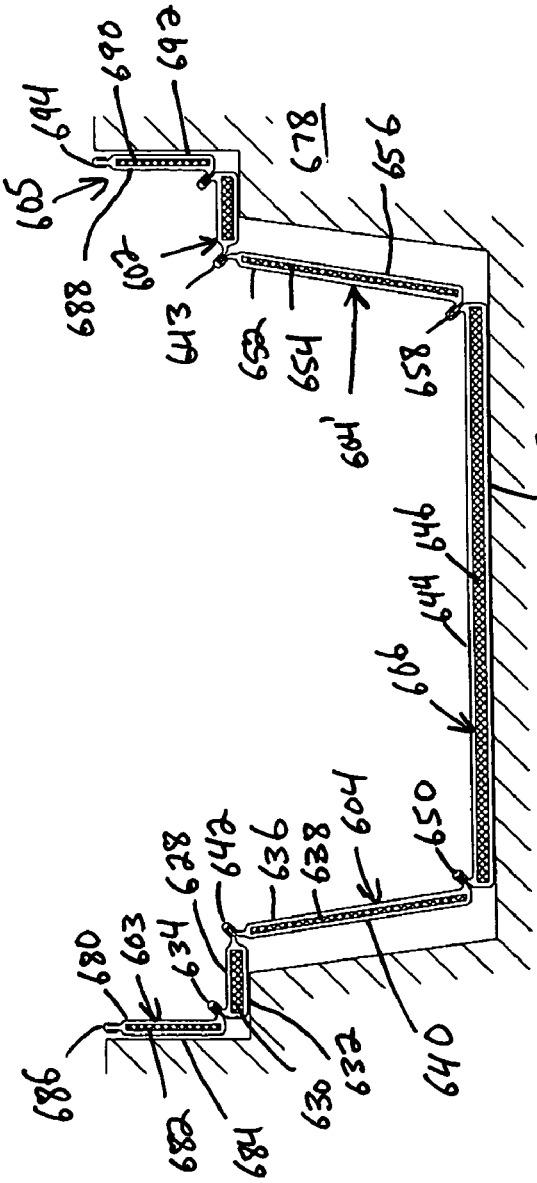
FIG. 25 is a side cross-sectional view of the embodiment of FIG. 21.

FIG. 25 shows a cross-sectional view of the fixture guard system 600, which reveals the various configurations of the panels that cover the top, floor, and sidewalls of the tub fixture. The panels of FIG. 25 are shown without consistency of dimension for purposes of illustrating the details of the panels.

The top panel 602 includes an outer side 628 that faces away from the tub fixture 678 and that is a flexible sheet of woven polyethylene in this embodiment. A layer of foam padding 630, which may be thicker than then foam padding of vertical panels, is positioned behind the outer side 628 to provide cushioning to protect the tub fixture 678 from impacts. An inner side 632 is a sheet of flexible rubber that provides a non-skid surface. The inner side 632 contacts the top surface of the tub fixture 678 and prevents slippage of the fixture guard panel 602 so that a worker may stand on the panel 602 without the panel 602 slipping and to reduce the likelihood of the worker falling. Cross-stitching (not shown in FIG. 25), as shown in FIG. 23, may also be used to sew together the outer side 628, padding 630, and inner side 632 to prevent the padding 630 and outer side 628 from slipping relative to the inner side 632. A hem 634 is sewn along one edge and a hem 642 is sewn along another edge of the panel 602 to hold the padding 630 between the two flexible sheets 628, 632. Thus, the two flexible sheets 628, 632 of the panel 602 with hemmed edges 634, 642 form an enclosure that contains the padding 632.

Hem 634 also acts as a junction between the top panel 602 and the outer panel 603. The outer panel 603 includes a first sheet of polyethylene 680, a second sheet of polyethylene 684, and foam padding 682 disposed between sheets 680, 684. A hem 686 is located at the termination point of the panel 603.

Hem 642 acts as a junction between the top panel 602 and the side panel 604. As discussed above for the previous embodiments, the hems of the embodiments shown herein are formed by edge tape that wraps over the ends of the two flexible sheets of material 628, 632 and thread stitching that passes through the edge tape and the ends of the flexible material. The edge tape provides additional strength for the hems.

The side panel 604 includes an outer side 636 that is made of woven polyethylene. An inner foam padding layer 638 is placed between the outer side 636 and an inner side 640 and provides protection from impacts. The inner side 640 is positioned behind the padding layer 638 and is a flexible sheet of woven polyethylene.

While hem 642 holds one side of the panel 604 together, another hem 650 holds the other side together. Hem 650 also acts as a junction between the side panel 604 and the bottom panel 606. As discussed above with reference to FIG. 23, the floor panel 606 includes an outer side 644 that is a sheet of woven polyethylene. The floor panel further includes an inner padding layer 646, which may be thicker than padding layers of vertical panels, to provide protection from impacts. A bottom side 648 is a sheet of rubber that provides non-skid surface that contacts the floor of the tub fixture 678 to prevent skidding.

As shown in FIG. 23, cross-stitching secures the outer side 644, padding 646, and bottom side 648 together so that the outer side 644 and padding 646 do not skid relative to the bottom side 648. While the hem 650 holds one side of the bottom panel 606 together, another hem 658 holds the other side of the bottom panel 606 together. Hem 658 also acts as a junction between the floor panel 606 and another side panel 604'.

The side panel 604' of this embodiment includes an outer side 652 that is made of woven polyethylene. An inner foam padding layer 654 is placed between the outer side 652 and an inner side 656 and provides protection from impacts. The inner side 656 is positioned behind the padding layer 654 and is a flexible sheet of woven polyethylene. However, this side panel 604' as well as other side panels may alternatively be configured to only include a single sheet of polyethylene 652, such as for situations where a fixture requires less impact protection. The panel 604' of this embodiment includes a hem 643 around the tub shape to hold one end together in addition to the hem 658 at the other end. The hem 643 also acts as a junction between the side panel 604' and the top panel 602, which includes a hem 659 to hold the panel 602 together along the edge.

Hem 659 also acts as a junction between the top panel 602 and the outer panel 605. The outer panel 605 includes a first sheet of polyethylene 688, a second sheet of polyethylene 692, and foam padding 690 disposed between sheets 688, 692. A hem 694 is located at the termination point of the panel 605.

Figure 26:
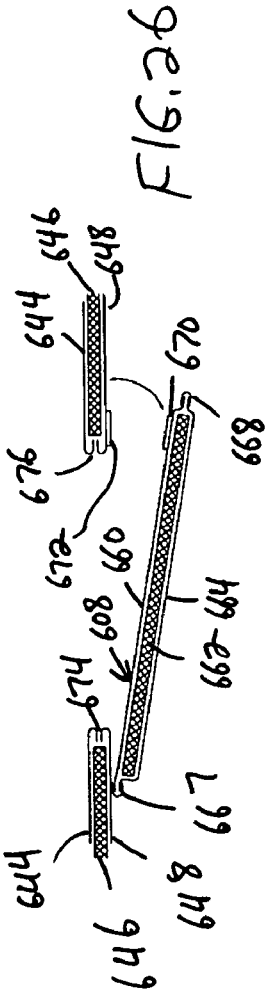
FIG. 26 is a side cross-sectional view of the floor surface of the embodiment of FIG. 21.

FIG. 26 shows a cross-section of the floor panel 606 through the drain flap 608. The drain flap 608 includes an upper side 660 that is a sheet of woven polyethylene, an inner padding layer 662 for protection from impacts, and a lower side 664 that is a sheet of rubber for adding to the non-skid characteristic of the floor panel 606. The drain flap 608 is held together at one end by a hem 667 that ties the sheet 660 to the sheet 664 and also ties sheets 660 and 664 to sheet 648 of the floor panel 606 to provide a hinged connection. Another hem 668 holds the other end together.

A fastener 618, shown in FIG. 23, may be included to hold the drain flap 608 shut. In this embodiment, the fastener 618 is a hook and loop fastener, such as Velcro® tape, where one side 670 of the fastener 618 is mounted to the upper side 660 of the drain flap 608 and the other side 672 is mounted to the bottom side 648 of the floor panel 606. Thus, the drain flap 608 rotates downward toward the drain when the drain flap 608 is opened by a worker. As discussed above, the fastener 618 may be omitted as the floor of the fixture will hold the flap 608 in the closed position. As can also be seen in FIG. 26, the opening through the top side 644, padding 646, and bottom side 648 may be closed at the edges by hems 674, 676.

Figure 27:
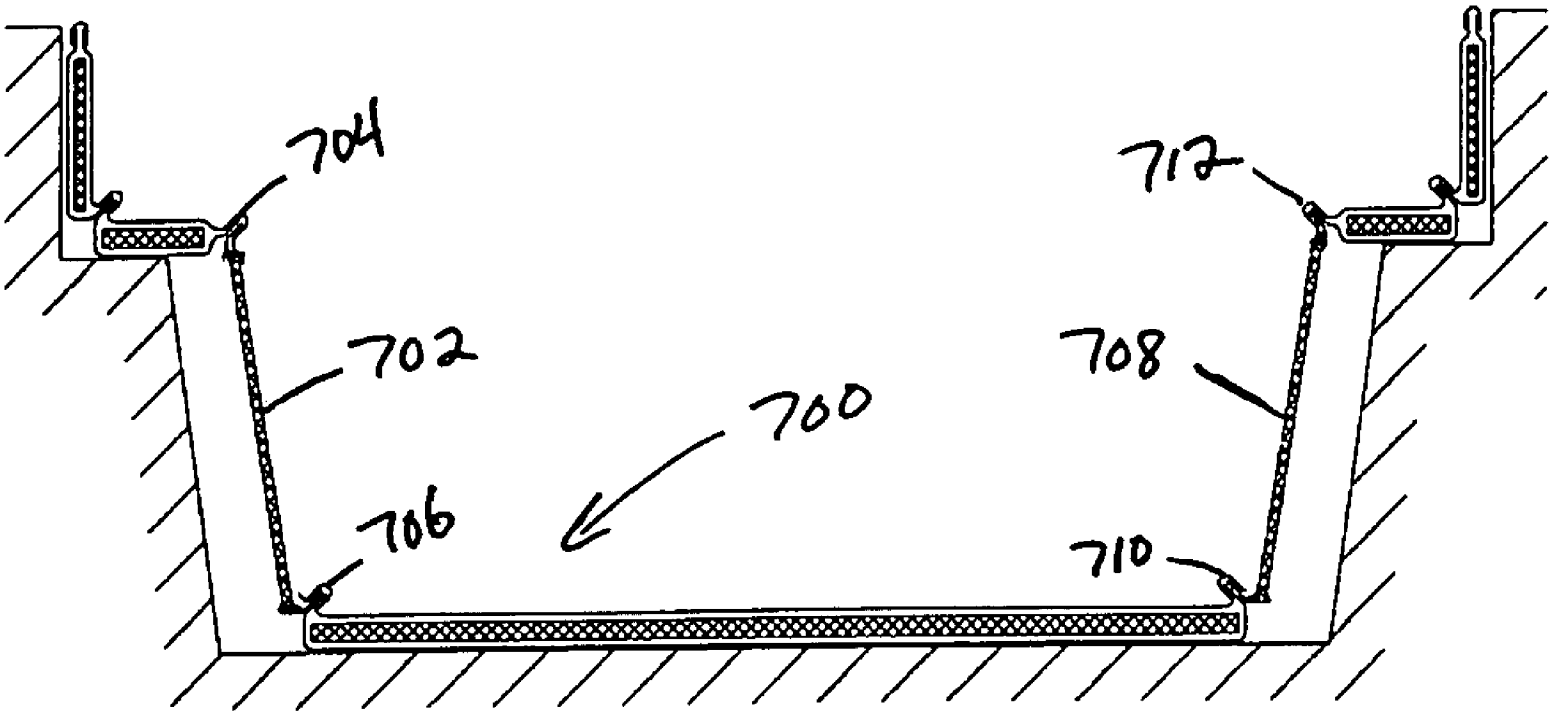
FIG. 27 is a side cross-sectional view of the floor surface of an alternate embodiment including non-enclosed padded panels.

FIG. 27 shows a cross-sectional view of a fixture guard system 700 such as the fixture guard system of FIG. 21 but with one exception. Rather than utilizing side panels for the fixture guard system 700 that include a layer of padding that is enclosed by polyethylene and/or non-skid rubber, sidewalls 702 and 708 of the fixture guard system are padding layers that are not enclosed. The lack of an enclosure for the padding results in exposure of the padding, but reduces the cost associated with the enclosure materials such that a non-enclosed padding panel 702, 708 may be utilized in a fixture guard system for situations where the protection otherwise provided by an enclosure is not necessary.

These padding layers 702, 708 are joined to adjacent panels at hemmed edges. For example, layer 702 is joined to adjacent panels at hemmed edge 704 and hemmed edge 706, while layer 708 is joined to adjacent panels at hemmed edge 710 and hemmed edge 712. These hemmed edges include edge tape overlapping the junction of the padding layer 702, 708 with the edge material of the adjacent panels, with stitching forming the hemmed edge. However, it will be appreciated that alternative methods of interconnecting one non-enclosed padding panel 702, 708 to an adjacent panel may involve heat sealing or other similar methods of adhesion.

The embodiments disclosed above are provided for purposes of illustration to demonstrate various configurations of fixture guard panels that are included within fixture guard panel systems. It will be appreciated that the combinations of panels of the systems described above may be combined in various other ways, depending upon the needs of a particular fixture. It will also be appreciated that the various fixture guard panels described above may be utilized as individual components to protect a fixture rather than being included in a multi-panel fixture guard system.

Although the present invention has been described in connection with various illustrative embodiments, those of ordinary skill in the art will understand that many modifications can be made thereto within the scope of the claims that follow. Accordingly, it is not intended that the scope of the invention in any way be limited by the above description, but instead be determined entirely by reference to the claims that follow.

What is claimed is:

1. A fixture guard panel for protecting a fixture, comprising:

a fixture guard floor panel comprising:

a first side made of flexible material and a second side made of flexible material with the first side facing away form a bottom of the fixture when the fixture guard system is positioned on the fixture;

an inner layer comprising padding that is disposed within the first and second sides of the fixture guard floor panel;

an opening through the first side, second side, and the inner layer of the fixture guard floor panel;

a flap with a first edge attached to the first material of the fixture guard floor panel such that the flap covers the opening, the flap having a size and shape that completely covers the opening while overhanging onto the second side such that the flap rest between the second side and the fixture when the fixture guard system is positioned on the fixture; and a fastener between a second edge of the flap and the enclosure, wherein the flap comprises a flexible material and wherein the fastener comprises a hook and loop fastener; and a plurality of fixture guard side panels, each having an outer edge that is attached to a corresponding outer edge of the fixture guard floor panel, the plurality of fixture guard side panels extending away form the bottom of the fixture when the fixture guard system is positioned on the fixture.

2. The fixture guard system of claim 1, wherein the first side and the second side of the fixture floor panel are hemmed together at one or more edges.

3. The fixture guard system of claim 1, wherein the first side and the second side are a plastic.

4. The fixture guard system of claim 3, wherein the plastic is woven polyethylene.

5. The fixture guard system of claim 1, wherein the padding is foam.

6. The fixture guard system of claim 1, further comprising:

an adhesive layer that is attached to the second side of the fixture guard floor panel and that adheres to a surface of the fixture when the fixture guard system is positioned on the fixture.

7. The fixture guard system of claim 6, wherein the flexible material of the first fixture guard panel is a plastic.

8. The fixture guard system of claim 7, wherein the plastic is high density woven polyethylene with a low density polyethylene coating.

9. A fixture guard panel for protecting a fixture, comprising:

an enclosure made of flexible sheet of material;

a padding layer within the enclosure;

an adhesive layer that is attached to the enclosure and that adheres to a surface of the fixture when the fixture guard panel is positioned on the fixture;

stitching that attaches the adhesive layer to the flexible sheet of material;

an opening through the enclosure; and a flap with a first edge attached to the flexible sheet of material such that the flap covers the opening, the first edge being attached to the flexible sheet of material by a sewn hem, the flap having a size and shape that completely covers the opening while overhanging onto the enclosure such that the flap rests between the enclosure and the fixture when the fixture guard panel is positioned on the fixture, the flap comprising a top sheet of flexible material, a bottom sheet of flexible material, and a padding layer that is disposed between the top sheet and the bottom sheet, and wherein the top sheet and the bottom sheet are joined at one or more edges to contain the padding layer of the flap.

10. The fixture guard panel of claim 9, wherein the flexible sheet of material is a plastic.

11. The fixture guard panel of claim 10, wherein the plastic is woven polyethylene.

12. The fixture guard panel of claim 11, further comprising stitching between the enclosure and the padding.

13. The fixture guard panel of claim 9, further comprising a fastener between a second edge of the flap and the flexible sheet of material.

14. The fixture guard panel of claim 13, wherein the fastener comprises a hook and loop fastener.

15. A fixture guard system for protecting a fixture, comprising:

a fixture guard top panel that is adjacent and in contact with a first surface of a fixture, the fixture guard top panel defining a first plane and further defining outer edges and an opening having inner edges, the fixture guard top panel comprising a first sheet and a second sheet joined at the outer edges and the inner edges and a padding layer between the first and second sheets;

a fixture guard front panel that is adjacent and in contact with a second surface of a fixture along a complete length and width of the fixture guard front panel, the fixture guard front panel defining a second plane that is perpendicular to the first plane;

a fixture guard floor panel that is adjacent a floor surface of the fixture, the fixture guard floor panel including a third padding layer that is disposed between a fifth sheet and sixth sheet, wherein the fifth sheet and the sixth sheet are joined at one or more edges to contain the third padding layer, the fixture guard floor panel defining a third plane that is parallel to the first plane and further defining outer edges;

a plurality of fixture guard side panels, each side panel being adjacent a side of the fixture and each side panel including a top outer edge and a bottom outer edge;

a plurality of fixture guard rim panes that are adjacent vertical rim surfaces of the fixture, each of the plurality of fixture guard rim panels including a second padding layer that is disposed between a third sheet and a fourth sheet, wherein the third sheet an the fourth sheet are joined at one or more edges to contain the second padding layer, each of the plurality of fixture guard rim panels defining a plane perpendicular to the first plane and extending upward from the first plane and further defining outer edges;

a first junction between an outer edge of the fixture guard top panel and an outer edge of the fixture guard front panel to allow the fixture guard top panel and fixture guard front panel to move relative to one another;

a second junction between the top outer edge of each side panel and an inner edge of the opening defined by the fixture guard top panel;

a third junction between the bottom outer edge of each side panel and an outer edge of the fixture guard floor panel;

a fourth junction between an outer edge of the fixture guard top panel and an outer edge of a first of the plurality of fixture guard rim panels to allow the fixture guard top panel and the first fixture guard rim panel to move relative to one another;

a fifth junction between an outer edge of the fixture guard top panel and an outer edge of a second of the plurality of fixture guard rim panels to allow the fixture guard top panel and the second fixture guard rim panel to move relative to one another; and a sixth junction between an outer edge of the first fixture guard rim panel and an outer edge of the second fixture guard rim panel to allow the first and second fixture guard rim panels to move relative to one another.

16. The fixture guard system of claim 15, wherein the first junction allows for rotation of the fixture guard top panel relative to the fixture guard front panel.

17. The fixture guard system of claim 15, wherein the fixture guard top panel includes an adhesive layer that adheres to a surface of the fixture when the first fixture guard top panel is positioned on the fixture.

18. The fixture guard system of claim 17, further comprising stitching that attaches the adhesive layer to the fixture guard top panel.

19. The fixture guard system of claim 15, further comprising:

an opening through the first fixture guard panel;

a flap with a first edge attached to the first fixture guard panel such that the flap covers the opening; and a fastener between a second edge of the flap and the first fixture guard panel.

20. The fixture guard system of claim 19, wherein the flap comprises a material of the first sheet a of the fixture guard floor panel.

21. The fixture guard system of claim 19, wherein the fastener comprises a hook and loop fastener.

22. A fixture guard system for protecting a fixture, comprising:

a first fixture guard top panel that is adjacent a top surface of a fixture, the top fixture guard panel including a padding layer that is disposed between a first sheet and a second sheet, and wherein the first sheet and the second sheet are joined at one or more edges to contain the padding layer, and the fixture guard top panel defining a first plane and further defining outer edges and an opening having inner edges;

a fixture guard front panel that is adjacent a front surface of the fixture, the fixture guard front panel including a second padding layer that is disposed between a third sheet and a fourth sheet, wherein the third sheet and the fourth sheet are joined at one or more edges to contain the second padding layer, the fixture guard front panel defining a second plane perpendicular to the first plane and further defining outer edges;

a fixture guard floor panel that is adjacent a floor surface of the fixture, the fixture guard floor panel including a third padding layer that is disposed between a fifth sheet and sixth sheet, wherein the fifth sheet and the sixth sheet are joined at one or more edges to contain the third padding layer, the fixture guard floor panel defining a third plane that is parallel to the first plane and further defining outer edges;

a plurality of fixture guard side panels, each side panel being adjacent a side of the fixture and each side panel including a top outer edge and a bottom outer edge;

a first junction between an outer edge of the fixture guard top panel and an outer edge of the fixture guard front panel to allow the fixture guard top panel and fixture guard front panel to move relative to one another;

a second junction between the top outer edge of each side panel and an inner edge of the opening defined by the fixture guard top panel; and a third junction between the bottom outer edge of each side panel and an outer edge of the fixture guard floor panel;

wherein each of the first, second, and third junctions comprise a hem.

23. The fixture guard system of claim 22, wherein the hem is formed by one of stitching, a heat weld, or an ultrasonic weld.

24. The fixture guard system of claim 22, wherein the first sheet and the second sheet are a plastic.

25. The fixture guard system of claim 24, wherein the first sheet of the fixture guard floor panel is plastic and the second sheet of the fixture guard floor panel is a non-skid material.

26. A fixture guard system for protecting a fixture, comprising:

a fixture guard top panel that is adjacent a top surface of the fixture, the first fixture guard panel including a padding layer that is disposed between a first sheet and a second sheet, and wherein the first sheet and the second sheet are joined at one or more edges to contain the padding layer, and the fixture guard top panel defining a first plane and further defining outer edges and an opening having inner edges;

a plurality of fixture guard rim panels that are adjacent vertical rim surfaces of the fixture, each of the plurality of fixture guard rim panels including a second padding layer that is disposed between a third sheet and a fourth sheet, wherein the third sheet and the fourth sheet are joined at one or more edges to contain the second padding layer, each of the plurality of fixture guard rim panels defining a plane perpendicular to the first plane and extending upward from the first plane and further defining outer edges;

a fixture guard floor panel that is adjacent a floor surface of the fixture, the fixture guard floor panel including a third padding layer that is disposed between a fifth sheet and a sixth sheet, wherein the fifth sheet and the sixth sheet are joined at one or more edges to contain the third padding layer, the fixture guard floor panel defining a third plane that is parallel to the first plane and further defining out edges;

a plurality of fixture guard side panels, each side panel being adjacent a side of the fixture and each side panel including a top outer edge and bottom outer edge;

a first junction between an outer edge of the fixture guard top panel and an outer edge of a first of the plurality of fixture guard rim panels to allow the fixture guard top panel and the first fixture guard rim panel to move relative to one another;

a second junction between an outer edge of the fixture guard top panel and an outer edge of a second of the plurality of texture guard rim panels to allow the fixture guard top panel and the second fixture guard rim panel to move relative to one another;

a third junction between and outer edge of the first fixture guard rim panel and an outer edge of the second fixture guard rim panel to allow the first and second fixture guard rim panels to move relative to one another;

a fourth junction between the top outer edge of each side panel and an inner edge of the opening defined by the fixture guard top panel; and a fifth junction between the bottom outer edge of each side panel and an outer edge of the fixture guard floor panel.

27. The fixture guard system of claim 26, wherein the first, second, third, fourth, and fifth junctions comprise a hem.

28. The fixture guard system of claim 26, wherein the second sheet comprises a plastic sheet.

29. The fixture guard system of claim 26, wherein the second sheet comprises a non-skid sheet.

30. The fixture guard system of claim 26, wherein the first sheet is plastic and the second sheet is a non-skid material.

* * * * *